US010837692B2

(12) United States Patent
Moon et al.

(10) Patent No.: US 10,837,692 B2
(45) Date of Patent: Nov. 17, 2020

(54) MODULAR CRYOGENIC SHIPPING SYSTEM

(71) Applicants: William G Moon, Provo, UT (US); Bao Tran, Saratoga, CA (US)

(72) Inventors: William G Moon, Provo, UT (US); Bao Tran, Saratoga, CA (US)

(73) Assignee: Reflect Scientific Inc., Orem, UT (US)

( * ) Notice: Subject to any disclaimer, the term of this patent is extended or adjusted under 35 U.S.C. 154(b) by 0 days.

(21) Appl. No.: 16/404,969

(22) Filed: May 7, 2019

(65) Prior Publication Data

US 2020/0124336 A1 Apr. 23, 2020

Related U.S. Application Data

(63) Continuation of application No. 15/855,914, filed on Dec. 27, 2017, now abandoned.

(51) Int. Cl.

| | |
|---|---|
| ***F25D 3/10*** | (2006.01) |
| ***F25D 29/00*** | (2006.01) |
| ***F17C 9/00*** | (2006.01) |

(52) U.S. Cl.

CPC ..... *F25D 3/105* (2013.01); *F17C 9/00* (2013.01); *F25D 29/001* (2013.01); *F17C 2270/02* (2013.01); *F25D 2201/12* (2013.01); *F25D 2331/80* (2013.01); *F25D 2600/04* (2013.01); *F25D 2700/00* (2013.01)

(58) Field of Classification Search

CPC ..... F17C 2203/01; F17C 2203/014; F17C 2203/03; F17C 9/00; F25B 19/005; F25D 29/003; F25D 29/001

See application file for complete search history.

(56) References Cited

U.S. PATENT DOCUMENTS

| | | | | |
|---|---|---|---|---|
| 5,595,319 | A * | 1/1997 | Householder | B65D 25/18 206/511 |
| 5,683,561 | A * | 11/1997 | Hollars | H01J 37/3405 204/298.25 |
| 6,789,391 | B2 * | 9/2004 | Graham | F25D 3/105 62/223 |
| 8,448,454 | B2 * | 5/2013 | Bowdish | F25D 3/10 62/46.1 |
| 2009/0183514 | A1 * | 7/2009 | Holmes | F25D 3/125 62/51.1 |
| 2012/0174600 | A1 * | 7/2012 | Bowdish | F25D 3/10 62/49.1 |
| 2014/0202176 | A1 * | 7/2014 | Bowdish | F24F 5/00 62/48.1 |
| 2017/0234583 | A1 * | 8/2017 | Moon | F25D 29/003 62/50.2 |

FOREIGN PATENT DOCUMENTS

JP 2015078147 A * 4/2015

* cited by examiner

*Primary Examiner* — Jianying C Atkisson
*Assistant Examiner* — Meraj A Shaikh
(74) *Attorney, Agent, or Firm* — Patent Law Office PC; Bao Tran

(57) ABSTRACT

A modular shipping system includes a bulk shipping space; and a base to support a pair of stackable cryogenic shipping subunits positioned in the bulk shipping space during long distance shipment, each subunit having a plurality of feet on a subunit bottom adapted to rest above a plurality of corresponding foot receptacles on a subunit lid, each subunit having its own cryogen connection source to maintain temperature during transit.

20 Claims, 17 Drawing Sheets

MODULAR CRYOGENIC SHIPPING SYSTEM

BACKGROUND

Various samples such as blood and sushi require ultralow temperature. These samples however, do not lend themselves to conventional freezing and shipping methods. For example, Serum should be stored at 4-8° C. until shipment takes place, or for max. 7 days. When kept for longer periods, serum samples should be frozen at −20° C. or lower and transported to the testing laboratory on frozen ice packs. Repeated freezing and thawing of serum samples for IgM testing should be avoided, as it may have detrimental effects on the stability of IgM antibodies.

In other examples, fish intended for consumption in an uncooked or raw state such as sushi, generally may not be frozen using conventional equipment, without adversely affecting the quality (i.e., the color and/or taste) thereof.

An economical and efficient way of preserving and shipping in bulk these specimens is needed.

SUMMARY

In one aspect, a modular shipping system includes a bulk shipping space; and a base to support a pair of stackable cryogenic shipping subunits positioned in the bulk shipping space during long distance shipment, each subunit having a plurality of feet on a subunit bottom adapted to rest above a plurality of corresponding foot receptacles on a subunit lid, each subunit having its own cryogen connection source to maintain temperature during transit.

In another aspect, a modular shipping system includes a heat exchanger coupled to a cryogenic supply tank to receive a cryogen; a port coupled to the heat exchanger, the port receiving ambient air and heat from the shipping container; fans coupled to the heat exchanger; a bulk shipping space; and a plurality of cryogenic shipping subunits positioned in the bulk shipping space during long distance shipment, each having its own cryogen source to maintain temperature while the subunit is delivered to a subunit destination.

Advantages may include one or more of the following. The shipping container can be deployable anywhere at any time. The cryogenic cooler is particularly useful for shipping products, which are disposed at a super-frozen temperature. For example, a product disposed at a super-frozen temperature may be shipped in a sealed container. Upon arrival at a facility, such as a distribution center or a warehouse, the container may be connected to a cryogenic cooler, which may maintain the interior thereof at a super-frozen temperature for an extended period of time (essentially indefinitely). This is advantageous in that it enables the product to be stored at a super-frozen temperature for as long as necessary.

Other advantages of the preferred embodiments may include one or more of the following. The system allows harvesting of fish, such as tuna and the like, in areas of the world where there is little local demand for sushi-grade product, and transported the product at cryogenic (i.e., super-cooled) temperatures of less than −40 degrees C. to the sushi markets. At these temperatures tuna and the like maintain suitable freshness for sushi purposes to thus retain the relatively high quality and premium prices associated with sushi-grade product. The system allows conventional boats to harvest high quality sushi at a low cost. Moreover, the system is reliable, unlike mechanical units that are prone to mechanical failure, in which about 5 to 10 percent of shipments are lost due to spoilage primarily due to mechanical breakdown and human error. The system is simple to operate and does not need an electric generator (i.e., genset) to provide electric power for the refrigeration unit. The system does not require ships equipped for "reefer" (i.e., refrigerated) shipments, i.e., on ships capable of providing a continuous supply of fuel and/or electricity to the containers and including technicians capable of servicing the units in the event of a failure en-route.

Alternatively, the cryogenic cooler may be coupled to a container including product disposed at a super-frozen temperature and the combination shipped together to another location. In one embodiment, the cryogenic cooler of this invention may be used to provide sushi-quality fish from a first location (such as a point of harvest) to distinct second location. Typically, the fish is frozen to a super-frozen temperature soon after harvest (e.g., within a few hours). The fish may be frozen and/or stored at the first location using cryogenic cooler as described below. Alternatively, a separate freezer, adapted for freezing product to super-frozen temperatures, may be utilized. The super-frozen fish are typically loaded into a container. Upon arrival at the second location, the container may be connected to a cryogenic cooler as described above. The fish may then be stored indefinitely at a super-frozen temperature at the second location. Thereafter, the container may be unloaded incrementally, e.g., into smaller containers for further shipment and/or storage, for ultimate use by the end-user of the sushi-quality fish. In this manner, the present system provides for a "super-frozen pipeline" or "cold chain" as discussed in greater detail hereinbelow. This method of providing sushi-quality fish is advantageous in that it tends to preserve the fish at a very high quality. Moreover, since the fish may be frozen at a super-frozen temperature for all but a few hours between harvest and consumption, this method also tends to reduce bacteria count in the fish relative to conventional non-frozen sushi-quality fish.

As mentioned above, the cryogenic cooler is useful for providing a "super-frozen pipeline" (i.e., an essentially unbroken delivery chain of super-frozen product) from a point of freezing to a point of delivery. The apparatus is particularly useful in providing an essentially continuous delivery chain of sushi-grade product from a point of harvest (e.g., and ocean going fishing vessel or fleet) to an end user (e.g., a distributor, wholesaler, retailer, or even a sushi restaurant).

For example, a forty-foot shipping container may be loaded with approximately 20 metric tons or more of super-frozen product (e.g., tuna loins) at a first location and shipped to a second location. Upon arrival at the second location (e.g., a distributor, wholesaler, or centralized warehousing facility), a cryogenic cooler is interfaced to the shipping container providing for automatic regulation of the super-frozen temperatures in the interior thereof. The super-frozen product may be stored for an indefinite time at the second location prior to being shipped to one or more third locations. The product may be shipped to the third locations in the same forty-foot container or in one or more smaller containers, such as but not limited to ISO LD3 containers 60'. At the one or more third locations a cryogenic cooler 20' may be interfaced to the shipping container to provide for automatic regulation of the super-frozen temperature in the interior thereof. This process may be repeated until the product is ultimately defrosted and/or consumed, e.g., at a supermarket, hotel, or restaurant.

Advantageously, providing storage capability at the second location (e.g., in container at a distributor site) enables the use and delivery of bulk liquid carbon dioxide. This may enable a distributor to produce dry ice (i.e., solid carbon dioxide) from the bulk liquid. The process of delivering super frozen product to one or more third locations consumes a significant volume of dry ice. Provision of liquid carbon dioxide at the distributor site for storage in a container provides for the on-demand production of dry ice at a relatively low cost and substantially eliminates the need for a distributor to maintain regular deliveries and/or dry ice inventories at relatively higher cost.

BRIEF DESCRIPTION

DETAILED DESCRIPTION

Figure 1A:
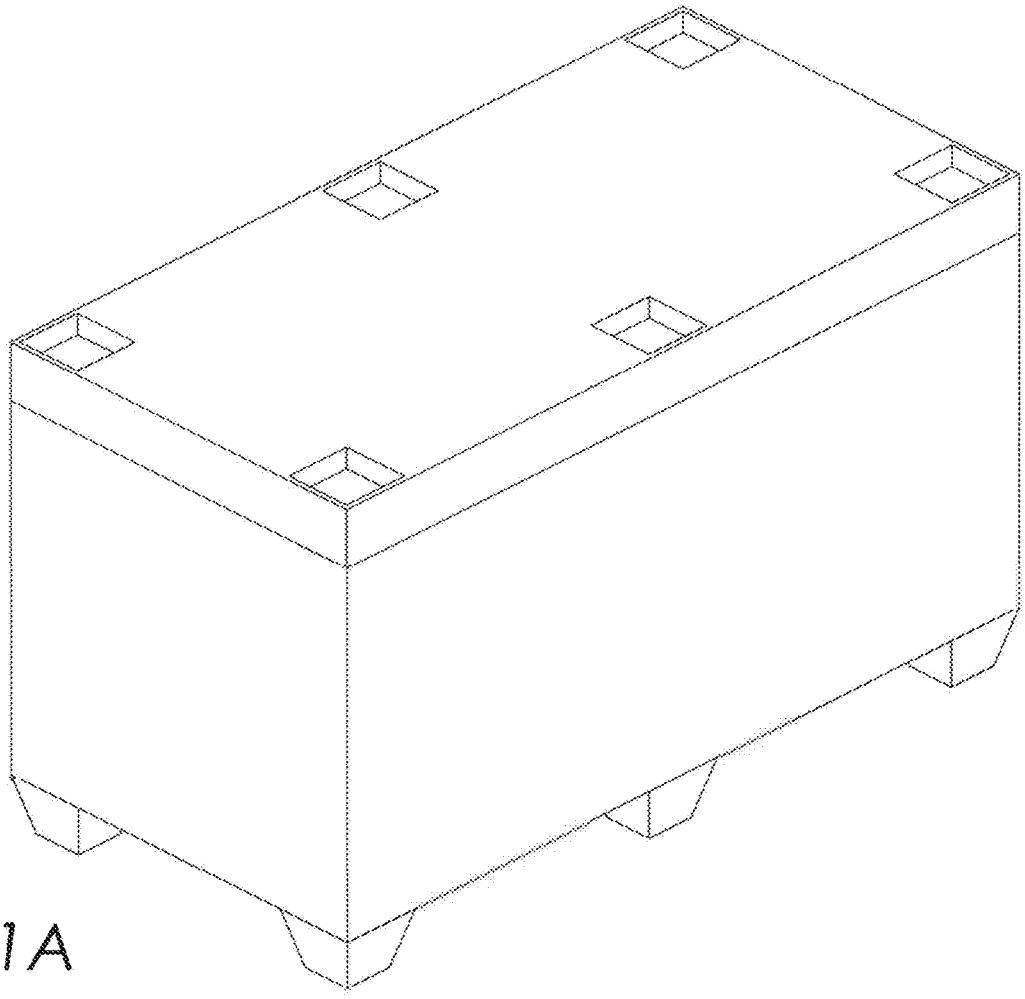
FIGS. 1A-1I show components for a cryogenically cooled shipping container, while FIG. 1J show an exemplary air flow schematic of a cryogenically cooled shipping container.

FIGS. 1A-1I show components for a cryogenically cooled shipping container. Turning now to FIG. 1A, an exemplary Modular Shipping Container is shown. The modular shipping container (hereafter referred to as the "container") is 7 feet wide by 3.5 feet tall (not including the 6 supports) and 3.5 feet wide. It has an outer metal box and an inner metal box made of 13 gauge aluminum or 15 gauge stainless steel sheet metal, both 0.07 inches thick. Between the boxes are vacuum insulated panels (VIP's) for 2 inches and an inch of polyurethane foam. The polyurethane foam secures the VIP's in position, fills voids, and increases thermal resistance. The two boxes are welded together and create a thermal barrier for product in the container. Inside the thermal barrier is h-inch diameter copper pipe that spirals from the top quick connect, around the outside circumference of the sheet-metal-payload-bay box and ends at the bottom quick connect. When the unit demands cooling, the liquid nitrogen flows through the copper pipe. The copper pipes are in very close proximity to the payload bay for good thermal conduction. Inside the payload bay is a temperature sensing device that is connected to a battery operated wireless transmitter. The base of the modular shipping container has 6 supports. They are located near the 4 corners with 2 supports in the middle. This configuration provides efficient transfer using a forklift.

Figure 1B:
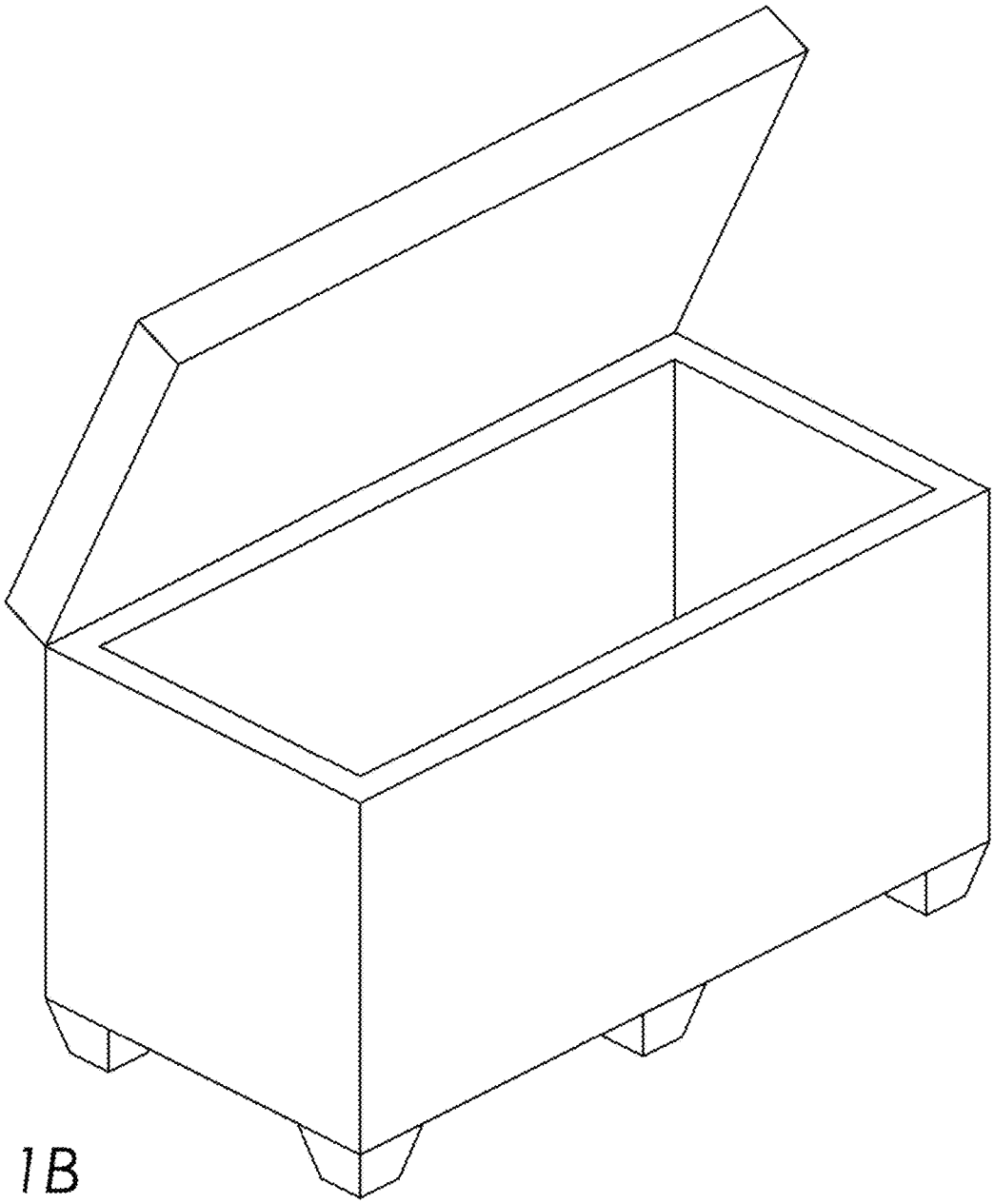

FIG. 1B shows the Modular cryogenic shipping container with lid open. The lid is on hinges and has a thermal seal similar to an oven door that reduces heat gain into the container. The lid has VIP's and foam polyurethane making it thermally equivalent to the walls of the payload bay. There are 6 indentations for stacking containers.

Figure 1C:
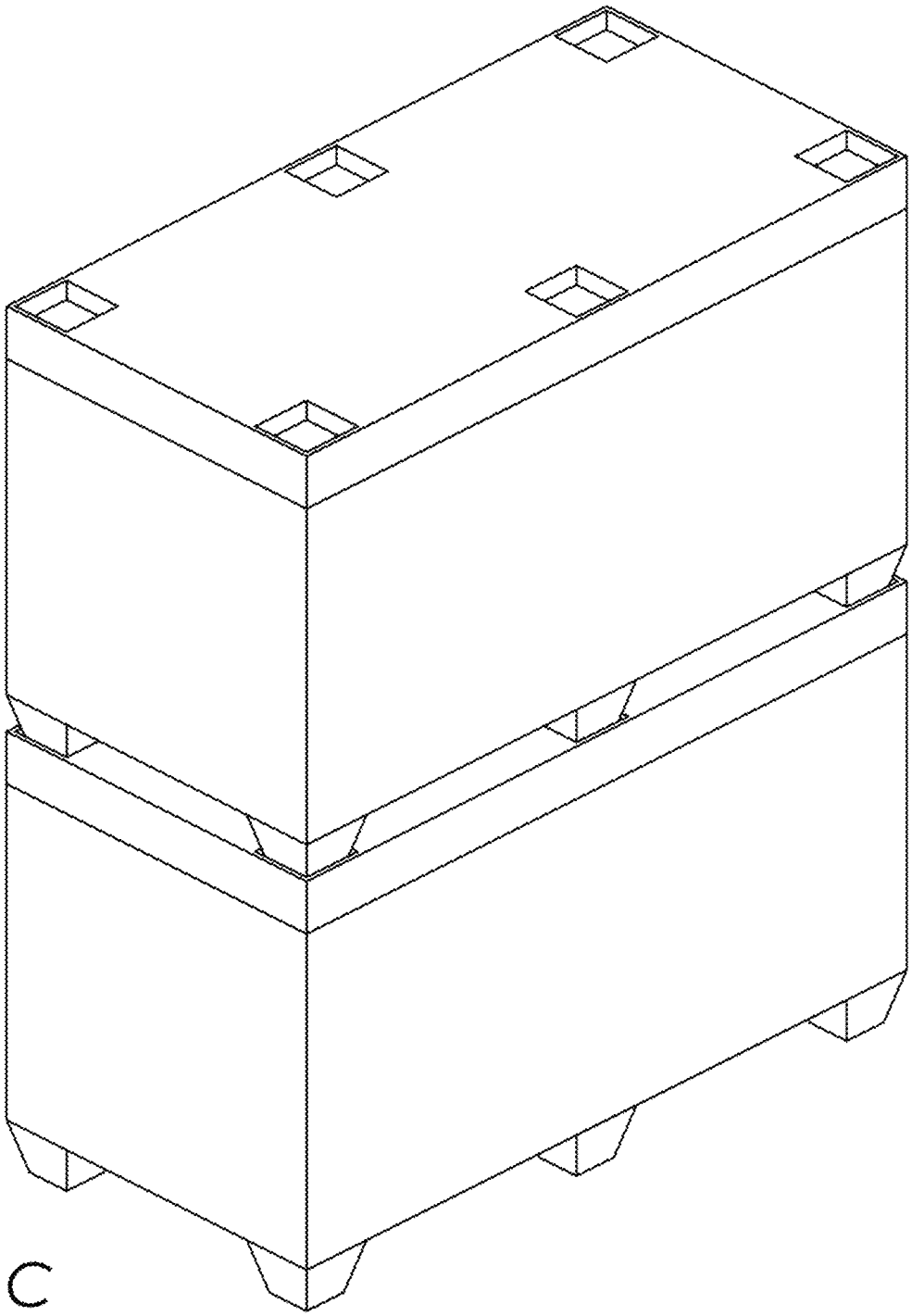

FIG. 1C shows Two Modular cryogenic shipping containers in a stacked position. The 6 supports on the base of one container locate in the 6 indentations in the lid, for staking. The weight of the container secures the unit without need for straps or tie-downs.

Figure 1D:
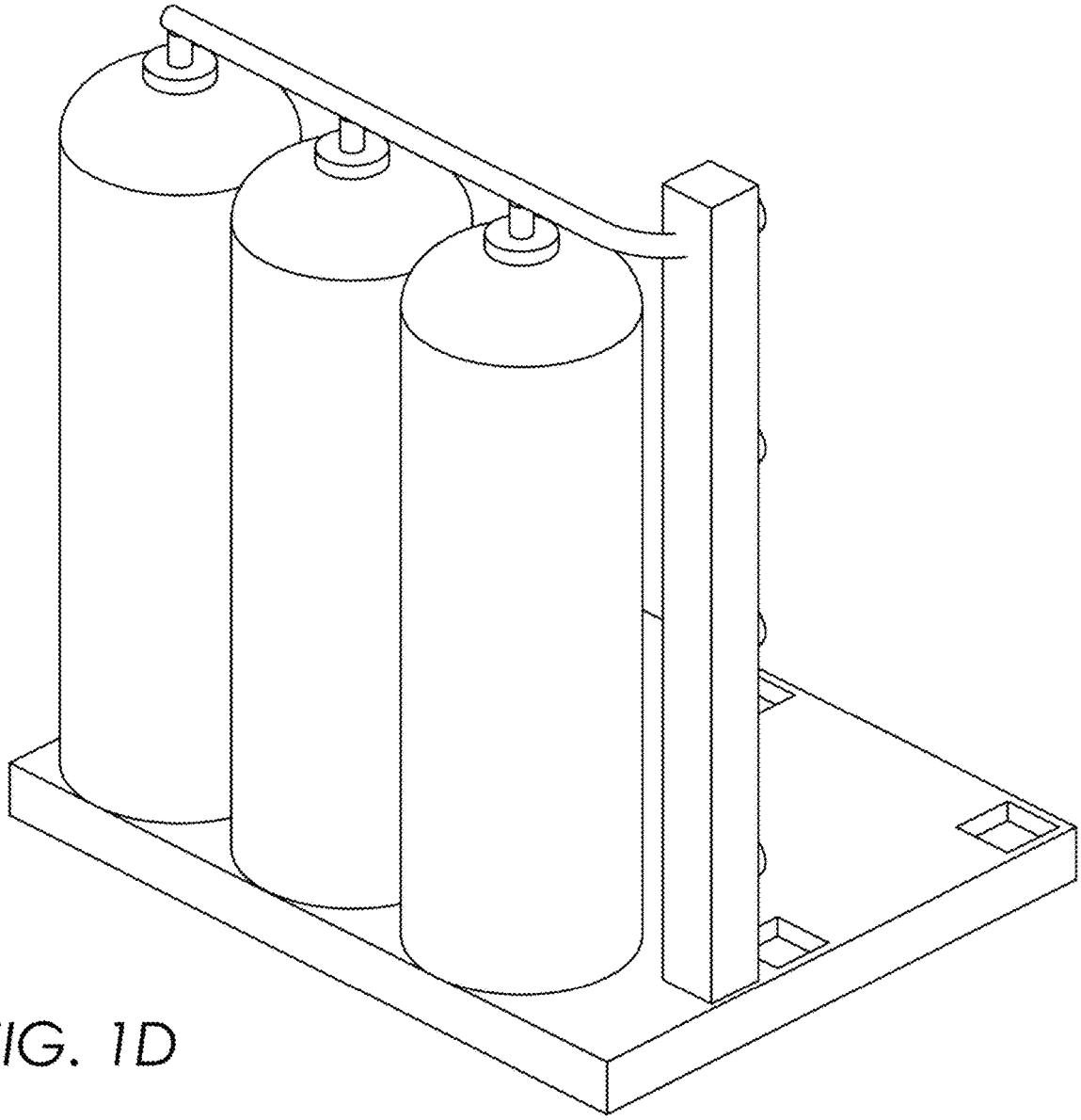

FIG. 1D shows the Cryogenic supply station. The station has a platform 7 feet wide and 5½ feet deep, 3 cryogenic Dewar tanks filled with liquid nitrogen, 2 cryogenic solenoid valves, quick connect post, temperature controller with telemetry, a Lithium-Ion battery, solar panels, and a green light that signals that the predetermined setpoint temperature has been attained.

Figure 1E:
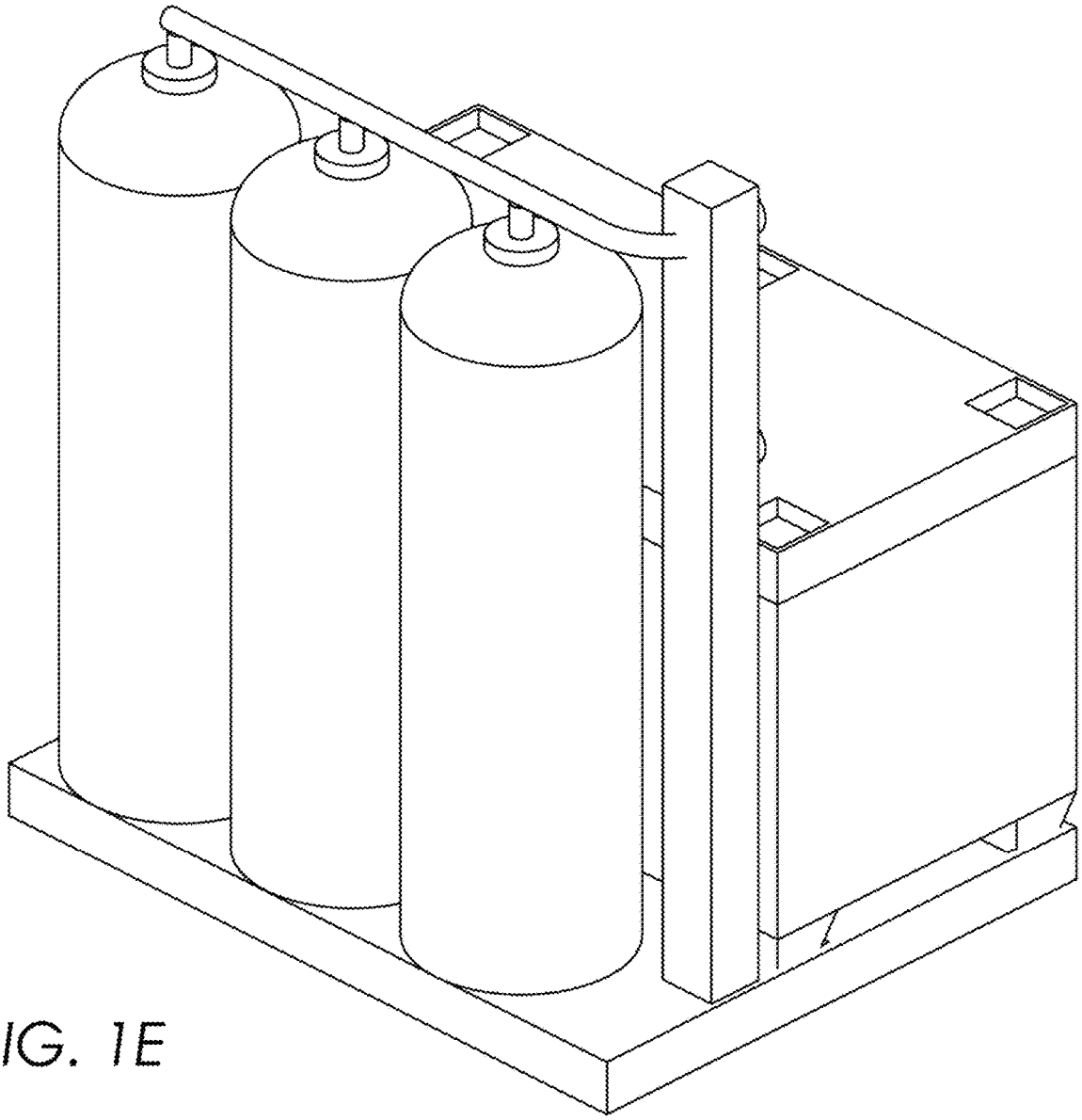

FIG. 1E shows the Cryogenic supply station with one modular cryogenic shipping container. The forklift operator places the container over the platform, and guides the 6 container supports into the 6 indentations on the platform. The advantage over prior art is that after the operator loads the container onto the supply station with the forklift, and removes the forks, he does not make any fluid or electrical connections. The weight of the container will compress and seal the spring loaded quick connects to the container. The electrical connections are wireless. The container is now a refrigeration unit capable of sustaining temperatures at −50 deg C., typical for transporting frozen fish, or as low as −150 deg C. for pharmaceutical purposes.

Figure 1F:
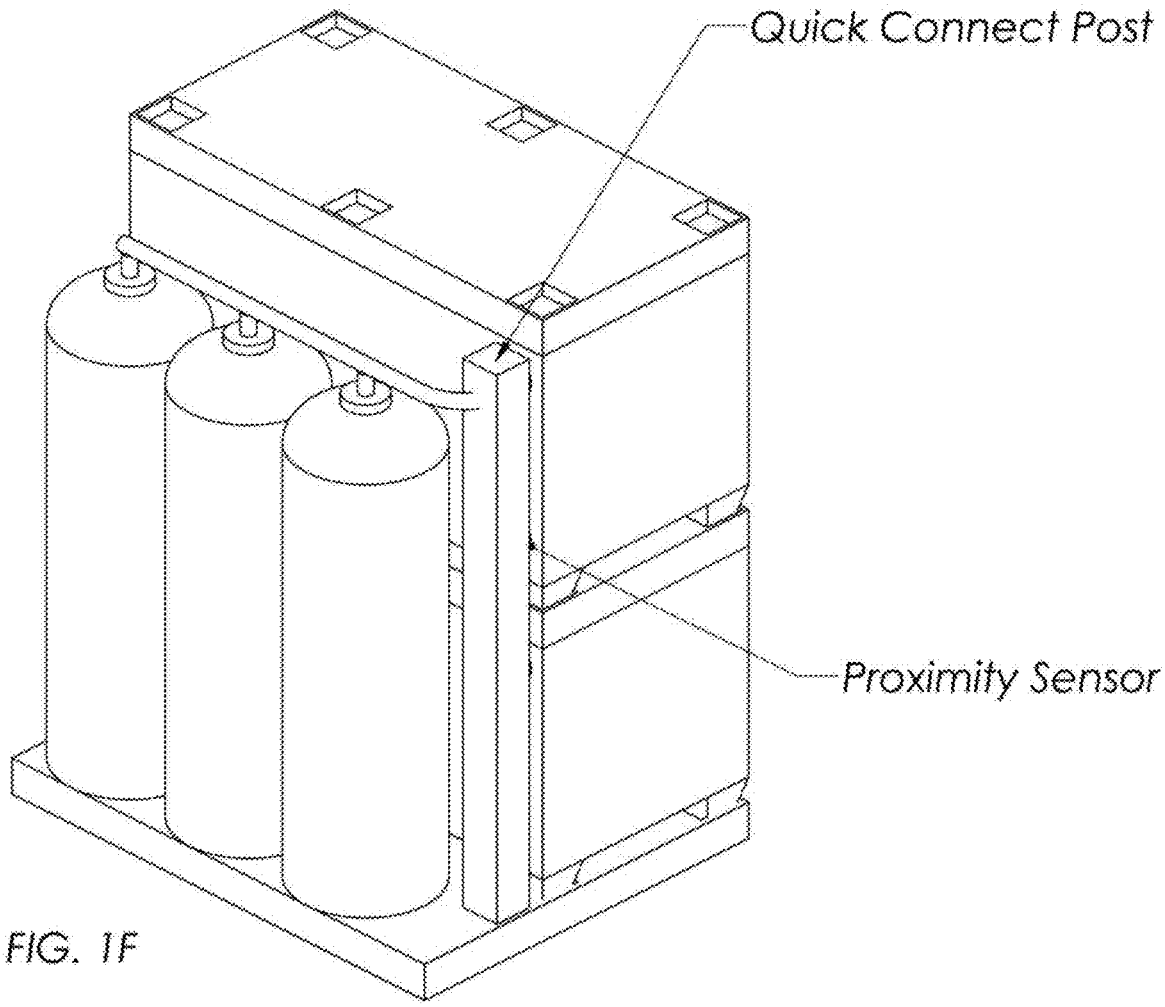

FIG. 1F shows the Cryogenic supply station with two modular cryogenic shipping containers. Both containers are identical and may be located in either position on the supply station. Two proximity sensors are located on the upper and lower half of the quick connect post. When the 1st container is installed, the lower proximity sensor enables syncing of the 1st thermostat to the thermal sensor in the 1st container, thereby ensuring coolant flows to the lower container location. Likewise, when the 2nd container is installed on top of the 1st container, the upper proximity sensor syncs the 2nd thermostat to the temperature sensor in the 2nd container, thereby ensuring coolant flows to the upper container location.

Figure 1G:
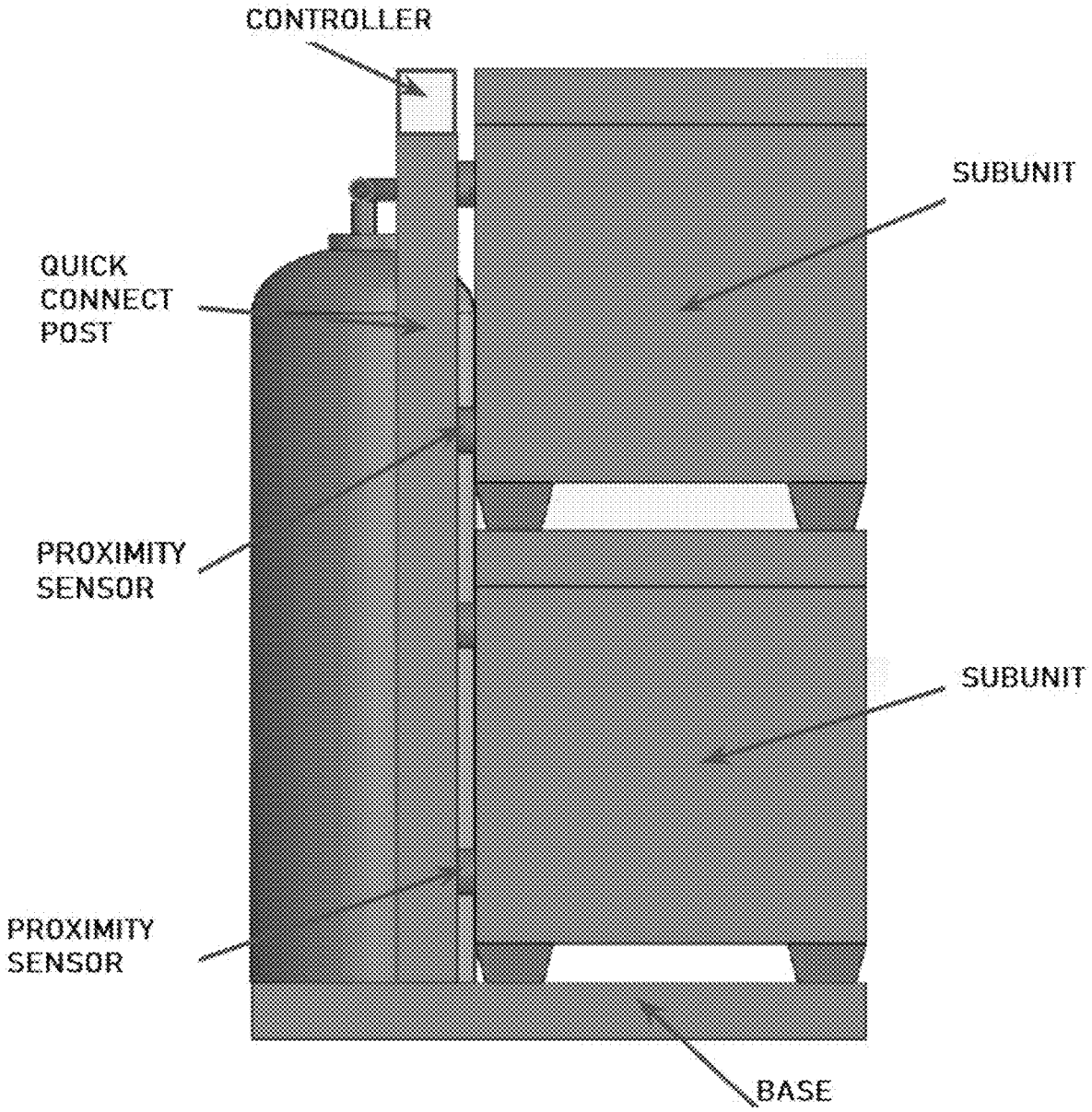

FIG. 1G shows the Side view of Cryogenic supply station with two modular cryogenic shipping containers and shows the supply and exhaust ports for the 1st and 2nd containers.

Figure 1H:
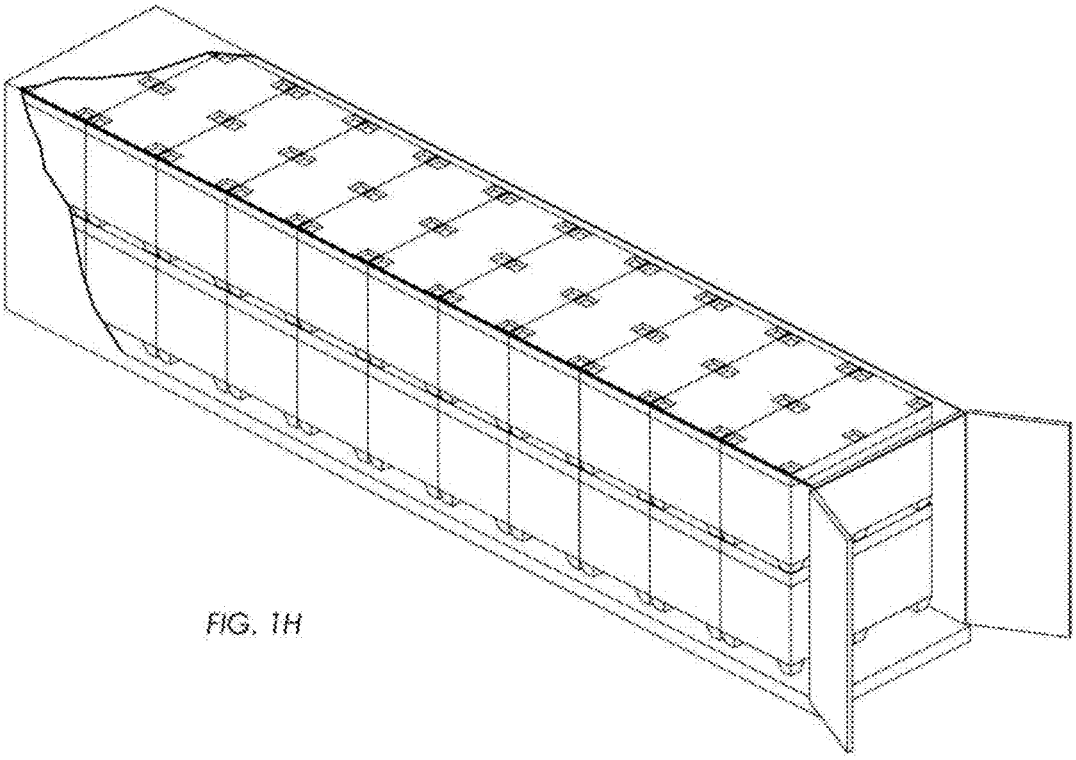

FIG. 1H shows the Forty foot refrigerated cargo shipping container with 22 modular cryogenic shipping containers. After the modular cryogenic shipping containers are filled with product and cooled to the setpoint temperature on the cryogenic supply stations, they are ready for delivery in a 40 foot refrigerated shipping container known as a reefer.

A green light, attached to the top of the supply station post, signals that the containers have reached the setpoint, typically −50 deg C. for fish. The containers are then forklifted into the reefer that is also at a −50 deg C. setpoint. With the refrigerated cargo shipping container at the same predetermined setpoint as the individual modular cryogenic shipping containers, the product will maintain the setpoint temperature with the proviso that the reefer functions properly and maintains the control setpoint.

In a 40 foot reefer, 22 modular cryogenic shipping containers, stacked 2 high, are placed into the reefer for transport across oceans and countries. Also, 10 modular cryogenic shipping containers fit into 20 foot reefers. In another aspect, several or even one cryogenic shipping container may be placed on a smaller truck for delivery to a market, restaurant, or pharmaceutical company.

Figure 1I:
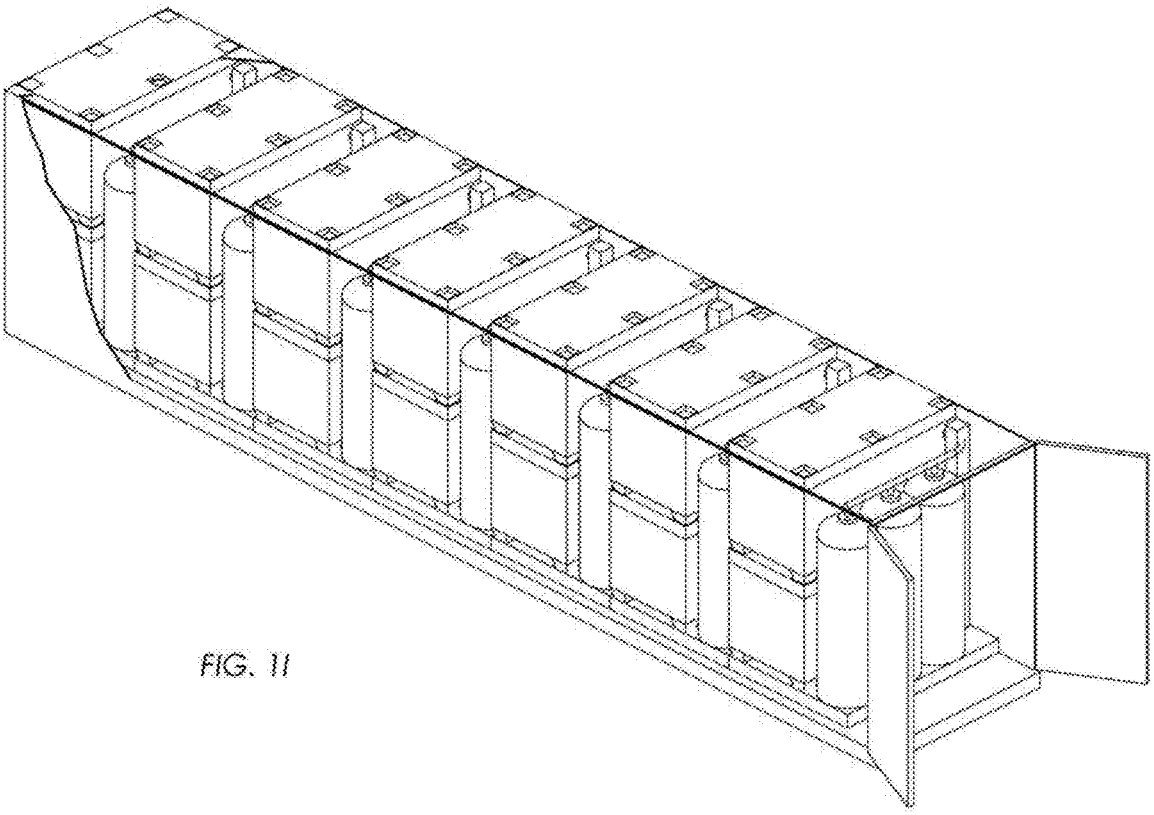

FIG. 1I shows the Forty foot cargo shipping container with 7 cryogenic supply stations and 14 modular cryogenic shipping containers. The cryogenic supply station with 2 modular cryogenic shipping containers, as an assembly, can be forklifted in a truck for transport to local establishments. The assembly can also be moved to a warehouse where it will autonomously maintain a −50 deg C. setpoint temperature for 10 days. Further, supply stations with 2 modular cryogenic shipping container assemblies can be placed into a 40 foot cargo shipping container that does not have refrigeration capability and transported throughout the world. The contents of all the modular cryogenic shipping containers will maintain a predetermined setpoint of −50 deg C. for 10 days.

Figure 1J:
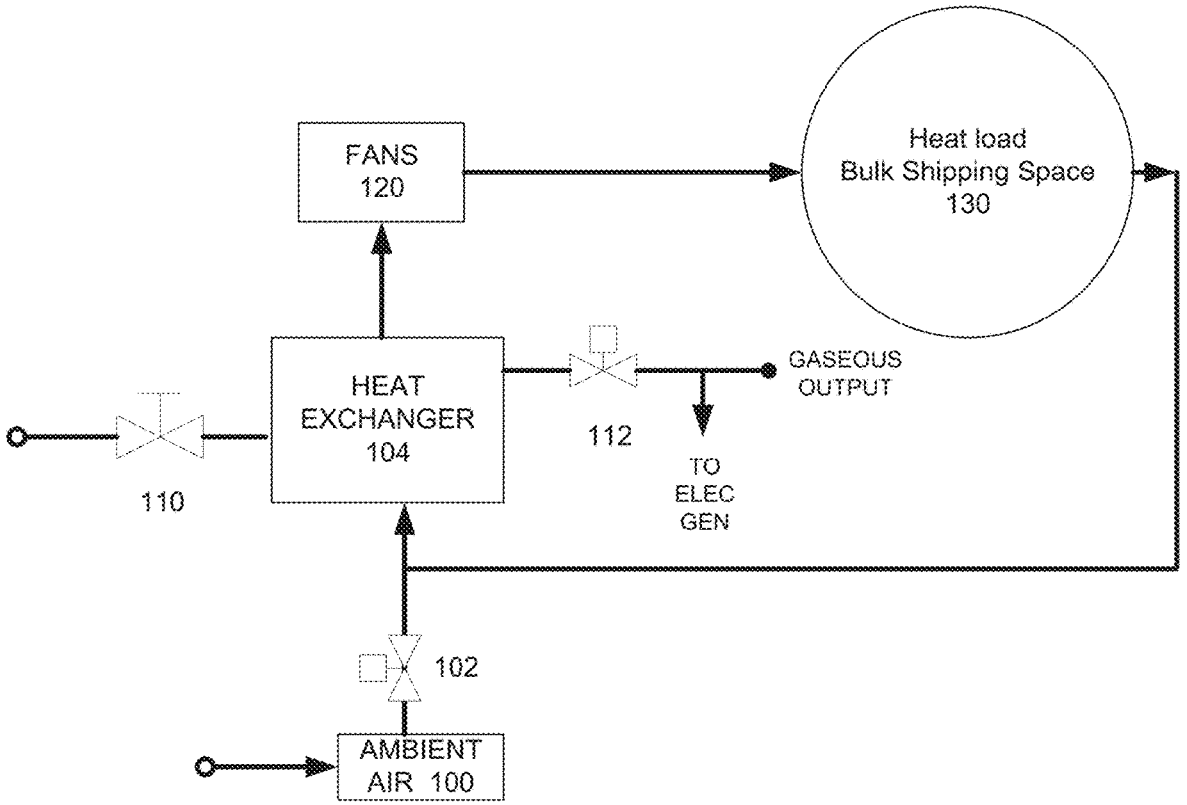

FIG. 1J show an exemplary modular cryogenically cooled shipping system. In the air flow schematic of FIG. 1, overall air flow with liquid cryogen inlet and output taps 110 and 112 are shown for turbine electric generation. Ambient air 100 is provided to a tap 102 to be provided to a heat exchanger 104 to modulate temperature of a shipping container 130. The heat exchanger 104 also receives return air from the shipping container 130. A liquid cryogen inlet 110 supplies cooling capacity to the heat exchanger 104, and the liquid cryogen is collected by tap 112 that can be sent to an electric generator or used as gaseous output.

A fan 120 takes cooled air from the heat exchanger 104 and provides cooled air to the racks of the shipping container. The fan 120 also provides a controlled environment especially designed for DCs. The DC uses thermal insulation, cryogenic heat removal and auxiliary electrical power generation.

The cooling system of FIG. 1 uses a liquid cryogenic element in an open loop heat exchanger (USPTO application #US20100024440), articulated auto positioning solar cells, turbine generator power from mechanical motion for the output of the heat exchanger (commonly owned USPTO Publication No. 20110225987A1), the content of which is incorporated by reference and Stirling cycle engine which drives a power generator through the use of devices described in commonly assigned USPTO application US20100275591, the content of which is incorporated herewith.

A typical over-seas shipping container is used as the outer housing. The internal walls are first painted using a ceramic based high performance aliphatic urethane, elastomeric acrylic paint to a coating depth of more than 10 mils. As disclosed in commonly owned U.S. Pat. No. 7,823,394 and US Publication No. 20100129588, the content of which is incorporated by reference, flat vacuum insulated panels are placed directly to the interior walls, roof and floor of the container. This thermally separates the external from the internal. This required a proper sizing of the heat exchanger properly to minimize fuel consumption.

Racking, for the electrical components, is installed in the interior of the container with air plenums placed towards the center of the container. A large fan assembly is located at the opposite end of the container of the main door. The fan assembly pulls air from the electrical units towards a heat pump system located on the opposite end. Automated baffles are installed in sectioned areas of the container and are controlled to balance air flows during times of low heat load.

The heat pump is located at the fan assembly and conditions internal/external air for temperature and humidity. The cooling is provided via one of two sources:

1. A cryogenically fuel heat exchanger removes heat energy from the internal air volume. This system is identical to the processes described in US US20100024440, The flow control of a cryogenic element to remove heat. Added features such as humidity control aid in the control of heat.

2. Ambient outer air is monitored and if the external air temperature is low, dampers allow for the introduction of this external air into the DC. This air source is then desiccated using the cryogenic fueled heat exchanger. If the external air supply is too low, a heater assembly in the heat pump unit warms the external air to appropriate levels.

Fuel for the cryogenic heat pump system will be from a separate, leased LIN trailer, typically of a size greater than 3000 gallons.

All of the electrical supply needed for the facility, not the electrical components, is supplied via a unit as described in commonly owned Publication No. US20100275591, Self Generating Power Generator for Cryogenic Systems, the content of which is incorporated by reference. The electrical supply would be dedicated to HVAC, UPS back-ups, and controls.

Safety feature would include oxygen monitoring, entrance/exit monitoring, temperature mapping (continuous), and facility faults and interrupts.

Figure 2:
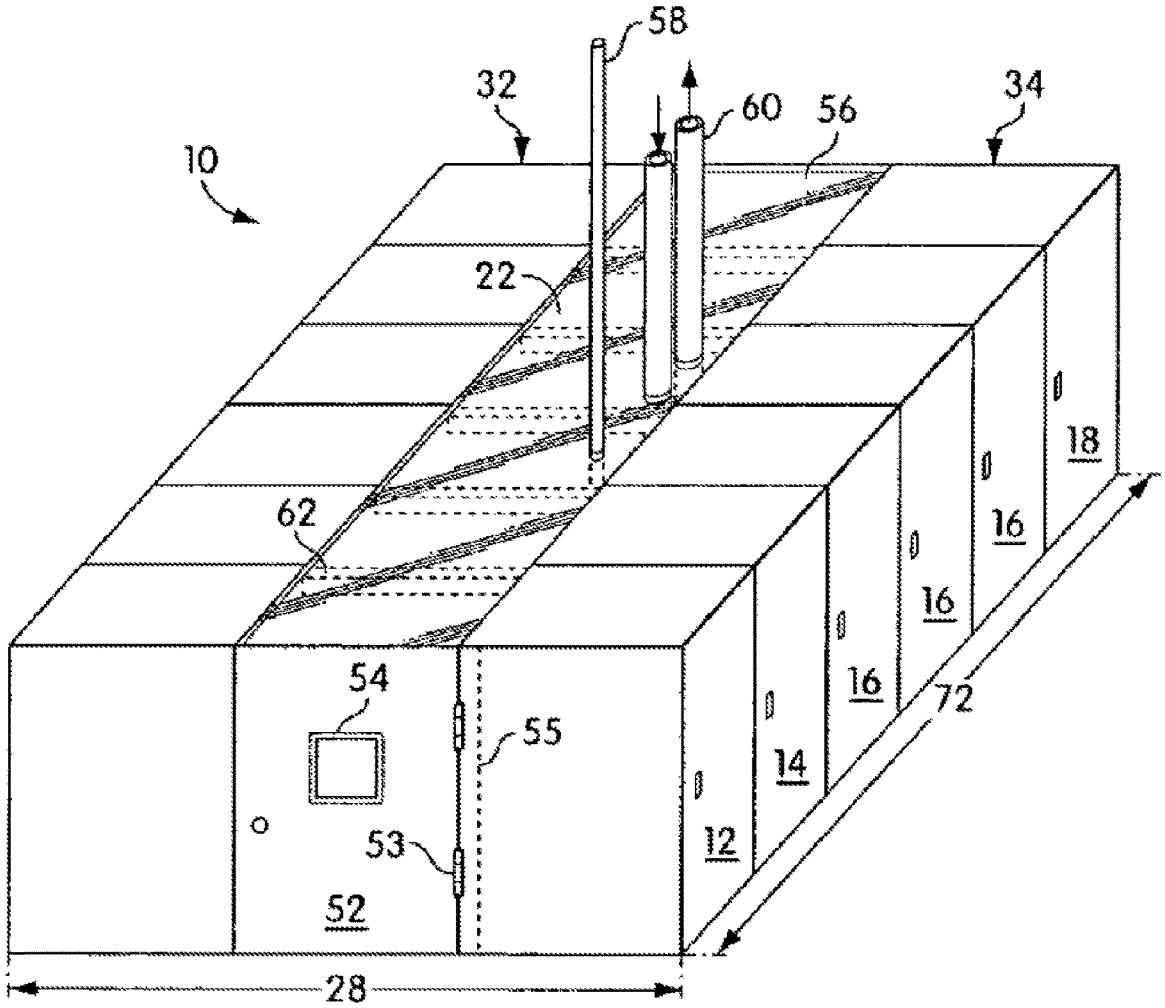
FIG. 2 shows a perspective view of the modular cryogenically cooled shipping container of FIG. 1.

Referring to FIG. 2, a perspective view of a modular shipping container 10 is shown. The modular shipping container includes a power distribution unit 14, a power protection unit 12, a floor mounted cooling unit 16, equipment racks 18, and a access room 22. The modular shipping container 10 also has a door 52 having a window 54, a roof panel 56, a cooling water supply and return 60, and a voltage feed 58. The cooling water supply and return 60 can consist of condenser water in the event that the cooling unit 16 is of the liquid cooled direct expansion variety, chilled water if cooling unit 16 is of the chilled water variety, or refrigerant supply and return if cooling unit 16 is of the air cooled direct expansion variety. The shipping container 10 is a modular unit comprised of the power distribution unit 14, the power protection unit 12 the floor mounted cooling unit 16, and equipment racks 18 positioned adjacent to each other to form a row 32 and a row 34. Row 32 and row 34 are substantially parallel. The power distribution unit 14 and the power protection unit 12 can be located directly adjacent to one another, and can be located at the end of one of the rows. The floor-mounted cooling unit 16 may be located and positioned adjacent to the power distribution unit 14. Remaining enclosures forming the at least one additional row in the shipping container 10 are equipment racks 18. The access room 22 is located between row 32 and row 34, and rows 32 and 34 comprise two of the perimeter walls of the modular shipping container 10.

The power distribution unit 14 typically contains a transformer, and power distribution circuitry, such as circuit breakers, for distributing power to each of the racks in the modular shipping container 10. The power distribution unit 14 provides redundant power to the racks 18 and can monitor the total current draw. An uninterruptible power supply can provide uninterruptible power to the power distribution unit 14. Preferably, the power distribution unit 14 includes a 40 kW uninterruptible power supply having N+1 redundancy, where the ability to add another power module provides N+1 redundancy. In one embodiment of the invention, input power to the power distribution unit 14 is received through the top of the rack from a voltage feed 58. In one embodiment, the voltage feed 58 is a 240 volt feed (or 208 volt feed for three-phase) coupled to the power distribution unit 14 that enters through the roof panel 56. Alternatively, the input power may be received from underneath the rack, as through a raised floor, or through the back of the rack.

The power protection unit 12 provides redundant power protection for electronic controller/equipment, as is contained in the equipment racks 18. The power protection unit 12 can have individual power modules and battery modules that can be individually added or removed to accommodate different load requirements. The use of multiple power modules and battery modules provides redundancy by allowing continued operation despite the failure of any one power module or battery module.

The floor mounted cooling unit 16 provides heat removal by use of the cryogenic cooler shown in FIG. 1, which enters the unit through supply line 60. Alternatively, the cooling units can provide heat removal using compressorized cooling via use of a direct expansion refrigerant-based unit, which can be in the unit itself. The cooling unit may contain a primary chilled water coil and secondary direct expansion coil within the same frame. The cooling unit can be conFIGured for air, water or glycol use. Cooled air can be released through the bottom of the unit or the top of the unit. In one embodiment of the invention, cool air is released from the cooling unit 16 out its front face, so that the air flow is from the back of the rack and out the front of the rack. The cooling unit 16 can further be conFIGured as one, two or three modules. In the embodiment shown in FIG. 2, a three-module cooling unit is used.

In the embodiment of FIG. 2, each of row 32 and row 34 is comprised of six racks. In embodiments of the invention, the number of racks and the function of the equipment in the racks can vary. In one embodiment of the invention, the racks 18 are modified standard 19 inch racks, such as those available from American Power Conversion Corporation of West Kingston, R.I., under the trade name NETSHELTER VX Enclosures®.

The back face of each of the power distribution unit 14, the power protection unit 12, the floor mounted cooling unit 16, and the equipment racks 18 faces the interior of the modular shipping container 10, or the access room 22. Essentially, the back faces of the racks in row 32 face the back faces of the racks in row 34. In one embodiment, the equipment racks 12-18 have their rear doors removed so that each mobile cryogen unit 18 remains open to the inside of the access room 22. In the embodiment shown, the modular shipping container 10 contains seven equipment racks 18. Alternatively, in another embodiment, six equipment racks 18 complete the rows, but more than seven equipment racks 18 can complete the rows contained in the shipping container 10 and can be adjacent to one another or adjacent to other enclosures in the shipping container 10, such as the power distribution unit 14, the power protection unit 12, or the floor mounted cooling unit 16.

The door 52 located at the end of the row of racks is attached with hinges 53 to a detachable frame 55. The detachable frame 55 is located behind the power protection unit 12. The detachable frame may be positioned behind any one of the power protection unit 12, the power distribution unit 14, or the equipment racks 18, depending on which of the units are positioned at the end of a row in the shipping container 10. The detachable frame 55 allows the door 52 to be quickly removed for replacement of the power protection unit 12 if necessary. The access room is accessible by the door 52 and can be monitored through the observation window 54. Preferably, a door 52 is located at each end of the access room 22. Generally, the door 52 is a 2×36 inch insulated, lockable steel door having an insulated observation window 54.

The water or refrigerant supply and return 60 can enter the access room through supply pipes into the roof 56 or directly into the roofs of the racks. The voltage feed 58 can also enter through the roof 56 or through the roofs of the racks. Alternatively, the water or refrigerant supply and return 60 and the voltage feed 58 enter the access room through a raised floor on which the modular shipping container rests or from another location outside of the room and into the racks, such as into the sides of the racks.

The roof panel 56 is preferably a semi-transparent plexiglass roof panel supported by steel supports 62 that are positioned at intervals along the length 72 of the shipping container 10. The roof 56 extends to cover the top of the access room 22 located in the middle of the rows of racks. The roof 56 can be easily detachable to allow for removal of racks 18 or the power protection unit 12 when necessary. A roof panel 56 constructed of semi-transparent plexiglass allows room light to enter the space defining the access room 22. Additionally, the plexiglass roof 56 is preferably substantially airtight.

The access room 22 is completely enclosed and has walls formed by the backside of the racks 18 and walls comprised of the door 52 attached at each end of the access room 22. Alternatively, panels without doors can be the walls that complete the access room. The access room 22 is a substantially airtight passageway when the roof panel 56 is in place. Thus, the modular shipping container 10 is an enclosed computer infrastructure defined on its outside perimeter by the front face of each of the racks 18, power protection unit 12, power distribution unit 14, and cooling unit 16, and having a access room 22 in its midsection. The outside walls of the access room formed by the doors 52 are a portion of two of the outside walls of the modular shipping container 10.

The modular shipping container 10 is operational when provided with a source of cryogen piping 60 and a voltage feed 58. Cryogen enters the floor mounted cooling units 16 via supply lines 60. A common supply line 60 can provide cooling water to one or more cooling units simultaneously, as the cooling units 16 are connected to the common supply 60 with flexible hose that is easily disconnected.

The modular shipping container 10 provides cooling for equipment in the shipping container as follows. Air from the room, or ambient air, filters through the front of the racks 18 to cool the equipment stored in the racks 18. Air enters through the front of the racks 18 and is expelled out of the backside of the racks 18. As the air passes through the equipment racks 18, the temperature of the air rises. The respectively warmer air is expelled into the access room 22. The access room 22 contains the warm air and prevents the warm air from mixing with air in the surrounding room. The cooling unit 16 draws warm air from the access room and returns cool air to the room outside the shipping container 10. The warm air enters the cooling units 16 directly from the access room 22. The cooling unit acts to lower the temperature of the air, and the cooled air is then released into the surrounding area. The air is recycled to the surrounding room at a substantially cooled temperature. For example, the cooling unit 16 generally receives air from the access room at 95° F. and cools it to a temperature of approximately 72° F. before it is released into the area surrounding the shipping container 10. The floor mounted cooling unit 16 operates at substantially higher supply and return temperatures, allowing realization of high capacity without latent heat removal.

Figure 3:
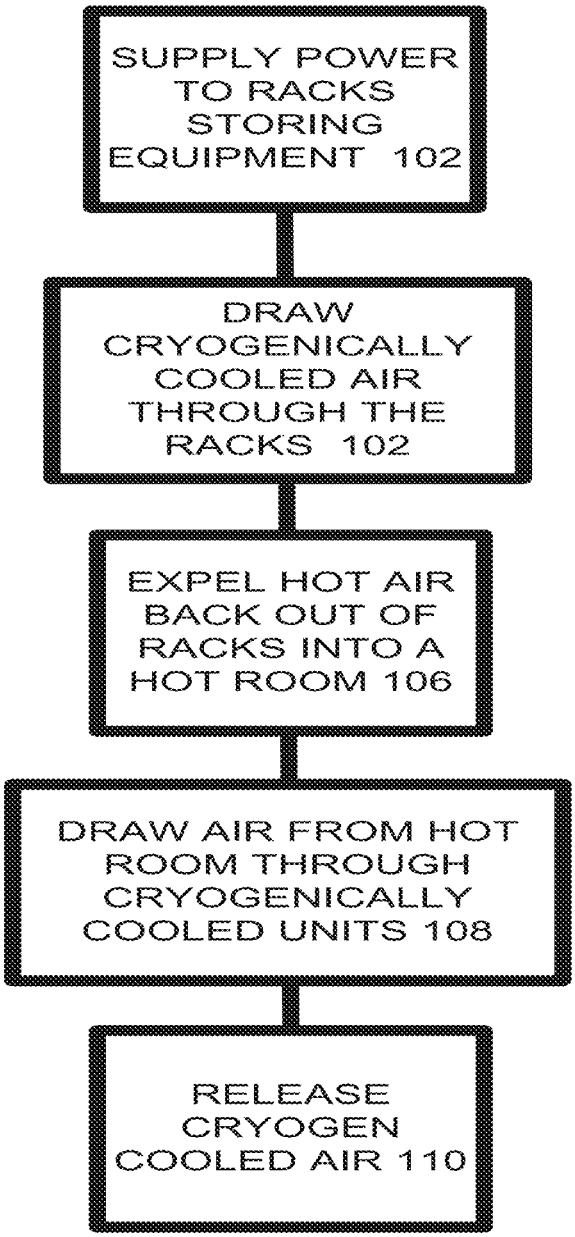
FIG. 3 shows an exemplary process for cooling the shipping container.

Referring to FIG. 3, with further reference to FIGS. 1-2, the shipping container 10 is configured to perform a process of cooling equipment stored in enclosed racks using an infrastructure having independent power and coolant supplies. The process 100 includes the stages shown, although the process 100 may be altered, e.g., by having stages added, deleted, or moved relative to the stages shown.

The process 100 of FIG. 3 includes stage 102, wherein power is supplied from a power distribution unit to a plurality of equipment racks 18. The equipment racks 18 may contain a variety of electronic equipment that requires a consistent power supply to avoid system downtime. Power is supplied via the voltage feed 58 that is connected to the power distribution unit 14, with the power protection unit 12 being preferably disposed adjacent to the power distribution unit to ensure redundant power supply.

At stage 104, the mobile cryogen units 18 draw cool air from the surrounding space through the front face of the mobile units 18. There may, for example, be an air distribution unit within the mobile units 18 and/or within equipment contained in the racks that draws the room air into the mobile cryogen unit 18 and distributes the air throughout the rack to cool components contained in the rack. As the air passes through the mobile cryogen unit 18, the air increases in temperature.

At stage 106, the shipping unit 18 expel the air at an increased temperature into the access room 22. The air is expelled out of the backside of the shipping units 18. As described above, in one embodiment, the shipping units 18 do not have rear doors. In other embodiments, rear doors may be included on the racks with the warm air being expelled into the access room through vents in the doors. Air is held in the access room 22 at an increased temperature and mixing of the warm air with the surrounding ambient air is prevented. In one embodiment of the invention, the modular shipping container is designed to maintain an air pressure in the access room that is approximately equal to the air pressure outside the access room. This allows one of the doors to be opened without allowing cool air to enter the access room. In one such embodiment, the cooling unit provides 160 cfm/kW.

At stage 108, the cooling unit draws the warm air from the access room 22. The cooling unit 16 uses the cold water from the cold water supply 60 to cool the air from the access room. At stage 110, the cooled air is released from the cooling unit into the surrounding room, which completes the cooling cycle. The air in the surrounding room is then drawn into the racks 18 once again, and the cycle continues.

In general, a portable freezer system that fits into space 18 of FIG. 2 is discussed next for transporting products, without the need of external power, with shipping times between a few hours and 10+ days, and will reliably maintain an operator defined set point as low as −150 deg. C. The freezer is comprised of a large payload bay, approximately 33.5 cubic feet, a large liquid nitrogen tank for supplying cooling means to the payload bay, an evaporator that encompasses the payload bay and substantially generates cooling, electronics for providing temperature control, rechargeable batteries to provide electrical power to the electronics for the duration of shipping, and a pallet structure capable of supporting all components of the freezer and also providing easy means for movement by standard fork lift methods.

Figure 4:
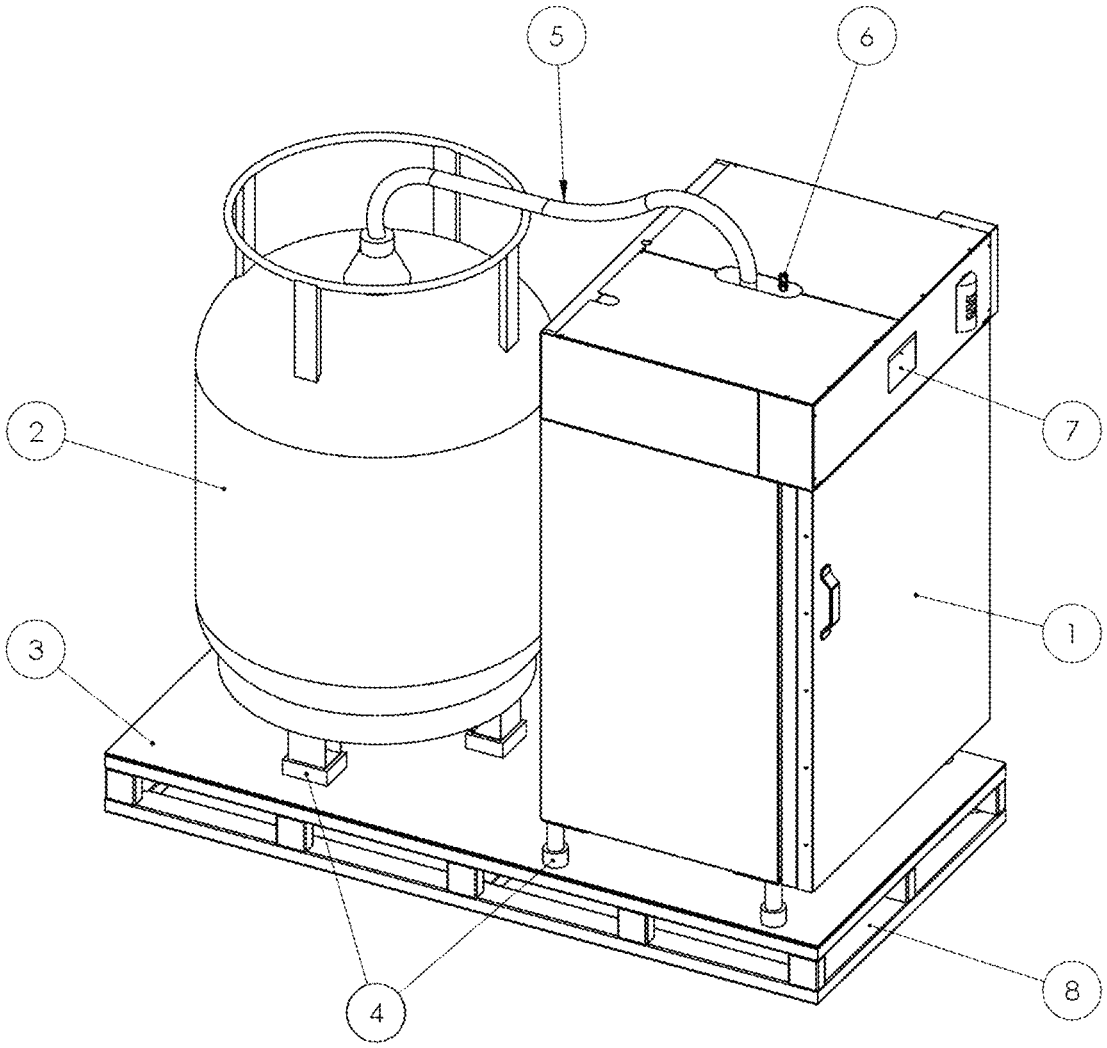
FIG. 4 is an exemplary 3D view of the shipping unit that fits into any of racks/space 12-18 of FIG. 2.
Figure 5:
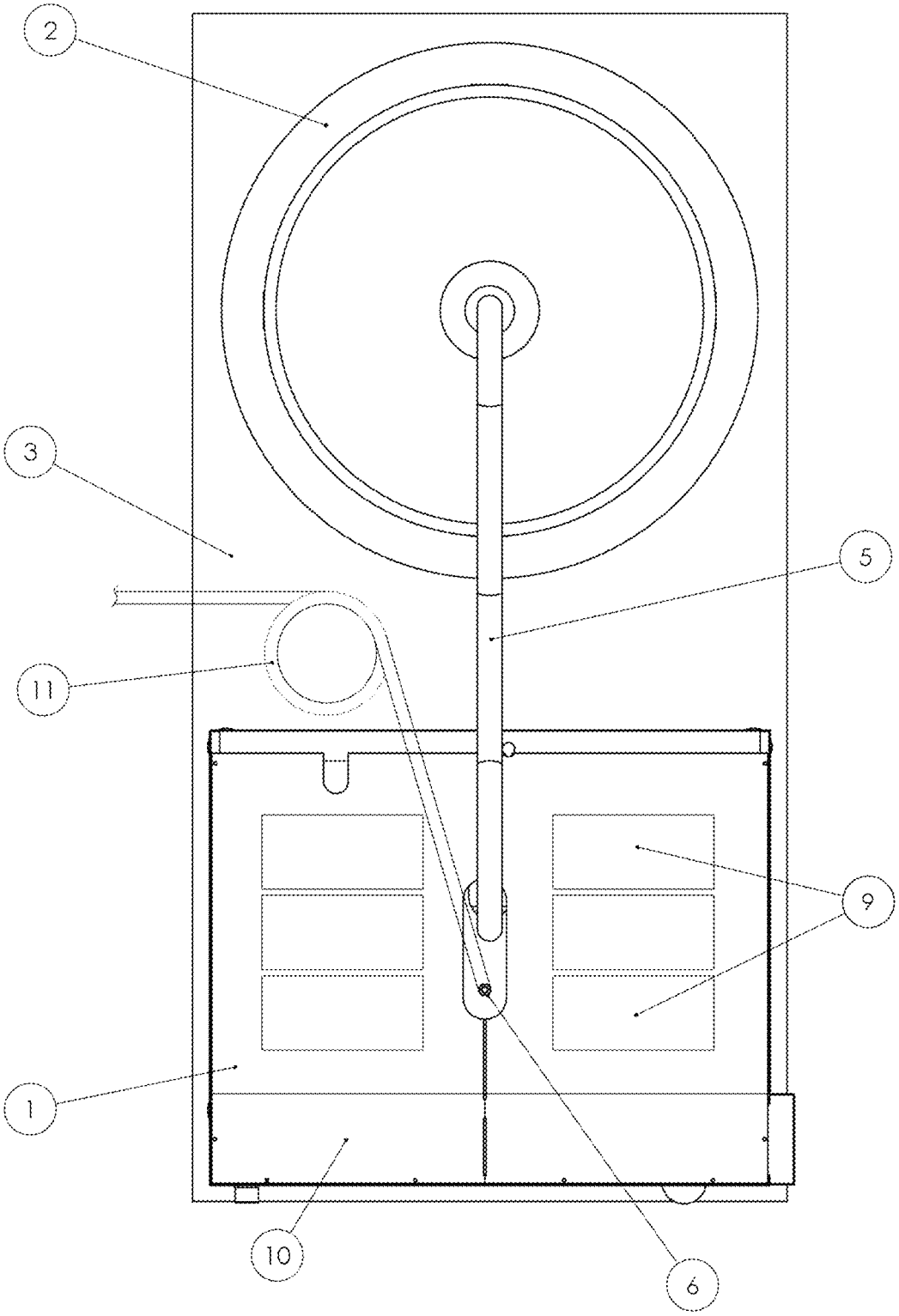
FIG. 5 is an exemplary top view of the shipping unit.
Figure 6:
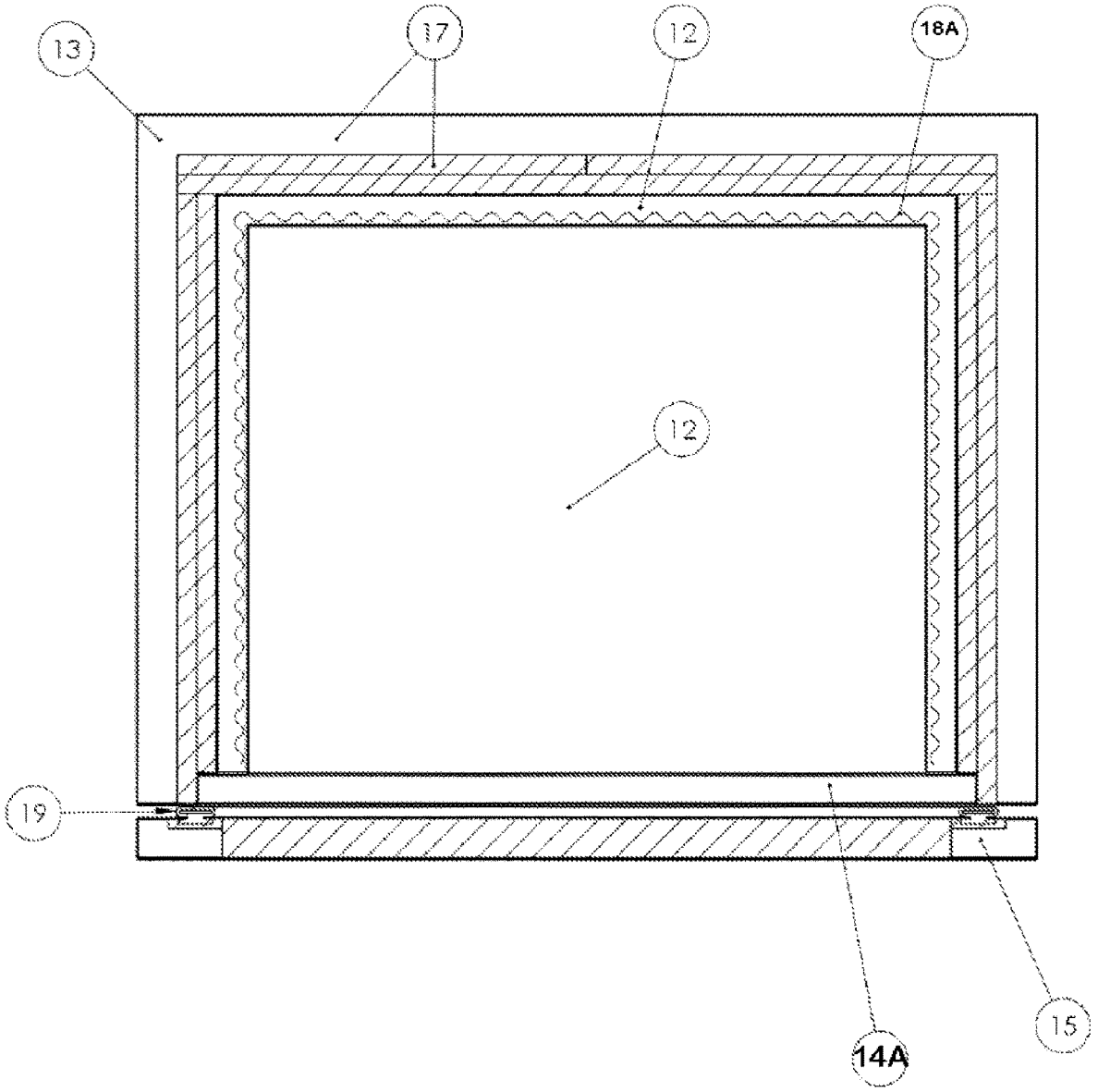
FIG. 6 is an exemplary cross section of the top view of the freezer.

The system of FIG. 2 and FIG. 4 provide a relatively large payload bay that can be sub-partitioned into smaller independently cryogenically cooled sub-units that can then be delivered to separate customers while maintaining cryogenic controlled chain of custody. The system provides controllable temperature that can be set to a wide range of between 20 deg C. and −150 deg C. The system provides an onboard power source that operates independently of any external power for the entire shipment. The system supports a shipping duration of 10+ days. Non-combustible fuel is used, improving safety. Further, the preferred embodiment has the potential of being much more reliable than current mechanical shipping units. The system has high mean time between failure (MTBF) rating and has a high reliability since the number of parts that have mechanical wear is orders of magnitude less than with a mechanical freezer. The only parts that wear in the preferred embodiment cooling system are limited to a cryogenic valve plunger and the fan shafts. In contrast, a mechanical freezer has a multiplicity of moving parts that continually wear, associated with the diesel generator and the compressor. Examples are a plurality of pistons, bearing surfaces, crankshafts, camshafts, intake and exhaust valves, fuel injectors, belts, and gears to name a few components that wear. Additionally, the system provides low and extremely low temperature shipping containers that operate independently from external power sources for as long as 10+ days.

The modular cryogenic shipping system is particularly useful for shipping raw food, which are disposed at a super-frozen temperature. For example, a product disposed at a super-frozen temperature may be shipped in a sealed container. Upon arrival at a facility, such as a distribution center or a warehouse, the container is self powered as a cryogenic cooler, which may maintain the interior thereof at a super-frozen temperature for an extended period of time (essentially indefinitely). This is advantageous in that it enables the product to be stored at a super-frozen temperature for as long as necessary. Alternatively, the cryogenic cooler may be coupled to a container including product disposed at a super-frozen temperature and the combination shipped together to another location. In one embodiment, the cryogenic cooler of this invention may be used to provide sushi-quality fish from a first location (such as a point of harvest) to distinct second location. Typically, the fish is frozen to a super-frozen temperature soon after harvest (e.g., within a few hours). The fish may be frozen and/or stored at the first location using cryogenic cooler as described above. Alternatively, a separate freezer, adapted for freezing product to super-frozen temperatures, may be utilized. The super-frozen fish are typically loaded into a container. Upon arrival at the second location, the container may be connected to a cryogenic cooler as described above. The fish may then be stored indefinitely at a super-frozen temperature at the second location. Thereafter, the container may be unloaded incrementally, e.g., into smaller containers for further shipment and/or storage, for ultimate use by the end-user of the sushi-quality fish. In this manner, the present system provides for a "super-frozen pipeline" or "cold chain" as discussed in greater detail hereinbelow. This method of providing sushi-quality fish is advantageous in that it tends to preserve the fish at a very high quality. Moreover, since the fish may be frozen at a super-frozen temperature for all but a few hours between harvest and consumption, this method also tends to reduce bacteria count in the fish relative to conventional non-frozen sushi-quality fish.

As mentioned above, the cryogenic cooler is useful for providing a "super-frozen pipeline" (i.e., an essentially unbroken delivery chain of super-frozen product) from a point of freezing to a point of delivery. The apparatus is particularly useful in providing an essentially continuous delivery chain of sushi-grade product from a point of harvest (e.g., and ocean going fishing vessel or fleet) to an end user (e.g., a distributor, wholesaler, retailer, or even a sushi restaurant).

Now referring to FIGS. 4 through 9, this shipping subunit is a freezer system comprised of a substantially large cryogenic tank 2, known as a Dewar tank, capable of holding at least 850 liters of liquid Nitrogen in the preferred embodiment, with a daily loss of less than 2% of the fluid in the tank. A vacuum type hose 5 connects the Dewar tank 2 to the freezer housing 1. The hose is connected to 150 feet of copper tubing 18 that surrounds the outside of the payload bay 12 in the preferred embodiment. The copper tube then exits the freezer compartment, where a cryogenic electromagnetic valve 6 controls the coolant flow. A 50 foot hose 11 completes the coolant path.

A plurality of deep cycle batteries 9 power the electronics. Between shipments the batteries are recharged at a 120 VAC power outlet.

During operation, the liquid Nitrogen is under natural pressure due to the characteristics of the Nitrogen. A safety valve, set at 22 psi in the preferred embodiment, maintains the Nitrogen in the tank to that pressure.

A common problem with a safety valve 20A (FIG. 7) is the extremely cold temperature of the liquid Nitrogen flowing through the valve can, on occasion, cause the valve to stick open. When the valve is stuck open, Nitrogen continues to flow, even after the pressure has dropped to a safe pressure, and the flow of cryogenic fluid should have stopped. The ongoing flow of liquid Nitrogen further drops the valve temperature and substantially increases the potential for a runaway condition that keeps the valves open continuously and needlessly from a safety standpoint, and subsequently wastes large amounts of Nitrogen.

To reduce this problem, heating fins 22 are added to the newly designed safety valve 21. These fins keep the temperature of the valve warmer, during pressure relief, thus reducing the problem of the safety valve sticking.

When the controller calls for cooling, the cryogenic valve opens, thus causing liquid Nitrogen to exit the tank 2, pass through the hose 5 connecting the Dewar to the freezer, flow through the 150 feet of copper tubing 18 and substantially cool the payload bay 12 and all the contents of the compartment. A separate compartment 13, located between the copper tubing and the outside environment, of between 2 and 4 inches thick contains a plurality of insulation materials 17 that substantially reduces the heat loss of the payload bay. A thermocouple inside the payload bay 12, measures the temperature at all times and sends a signal to the controller, where the temperature is carefully monitored and controlled. The payload bay 12 may be set to any temperature between 20 deg. C. and −150 deg. C. When the setpoint has been reached, the controller will stop the flow of liquid Nitrogen through the copper tubing 18 by turning the cryogenic electromagnetic valve off 6. The cryogenic valve 6 controls the Nitrogen flow in a location that is considered unique by those who are familiar with the state of the art. Typically, the control valve is located in the coolant path between the tank 2 and the freezer 1. The valve 6 is located at the exhaust port of the freezer, which provides equivalent control, but provides a substantially warmer environment for the valve, thus increasing the reliability and life of the valve.

The controller 100 then monitors the payload bay 12 temperature via the thermocouple and will use algorithms familiar to those skilled in the art of feedback control systems, such as PID (Proportional-Integral-Derivative) control, to maintain the setpoint within a reasonable limit, such as +/−3 C in the preferred embodiment.

The electronics for the controller 100 uses minimal power. Deep cycle batteries 9 maintain power during the shipment of product to its destination. After arrival, the shipping unit is plugged into a 120 volt AC source to recharge the batteries.

A concern that the exhausting Nitrogen gas may possibly deplete levels of Oxygen for the personnel near the shipper is alleviated by routing the Nitrogen gas through a hose 11, to the outside of the shipping vessel. Should there be a malfunction in porting the hose properly to the outside, an Oxygen Sensor attached to the shipping unit will immediately sound, alerting anyone nearby of the unsafe condition.

Typically, the losses through the payload bay door and gasket comprise a majority of the cooling losses. As a means to reduce the cooling losses, a rubber pneumatic seal 19 is placed between the door 15 and the payload bay 12. The seal is inflated from the Nitrogen gas that is readily available at all times, since it is a byproduct of the cooling process. A further reduction in cooling losses is accomplished with an additional impediment to the heat flow by adding a second door 14A interior to the main door 15.

To provide ease of transporting the shipping containment vessel between shipping docks and various modes of transportation, a pallet 3 supports all components of the vessel. The pallet support structure is designed in a manner that provides convenient access 8 for the forks of a forklift.

The entire shipping containment vessel may be subjected to large shocks and vibrations during shipment. Ground transportation, usually provided by semi-trailers, is particularly damaging near the front of the semi-trailer on rough roads. Frequencies between 2 hz and 25 hz, with accelerations between 0.5 and 1.6 g's are transmitted to loads, which can cause vessel damage. However, the tank and freezer are protected from theses shocks and vibrations by isolation dampers 4, which attenuate the shocks and vibrations. Further, the controller 100 has additional isolation dampers to protect the electronics.

Figure 7:
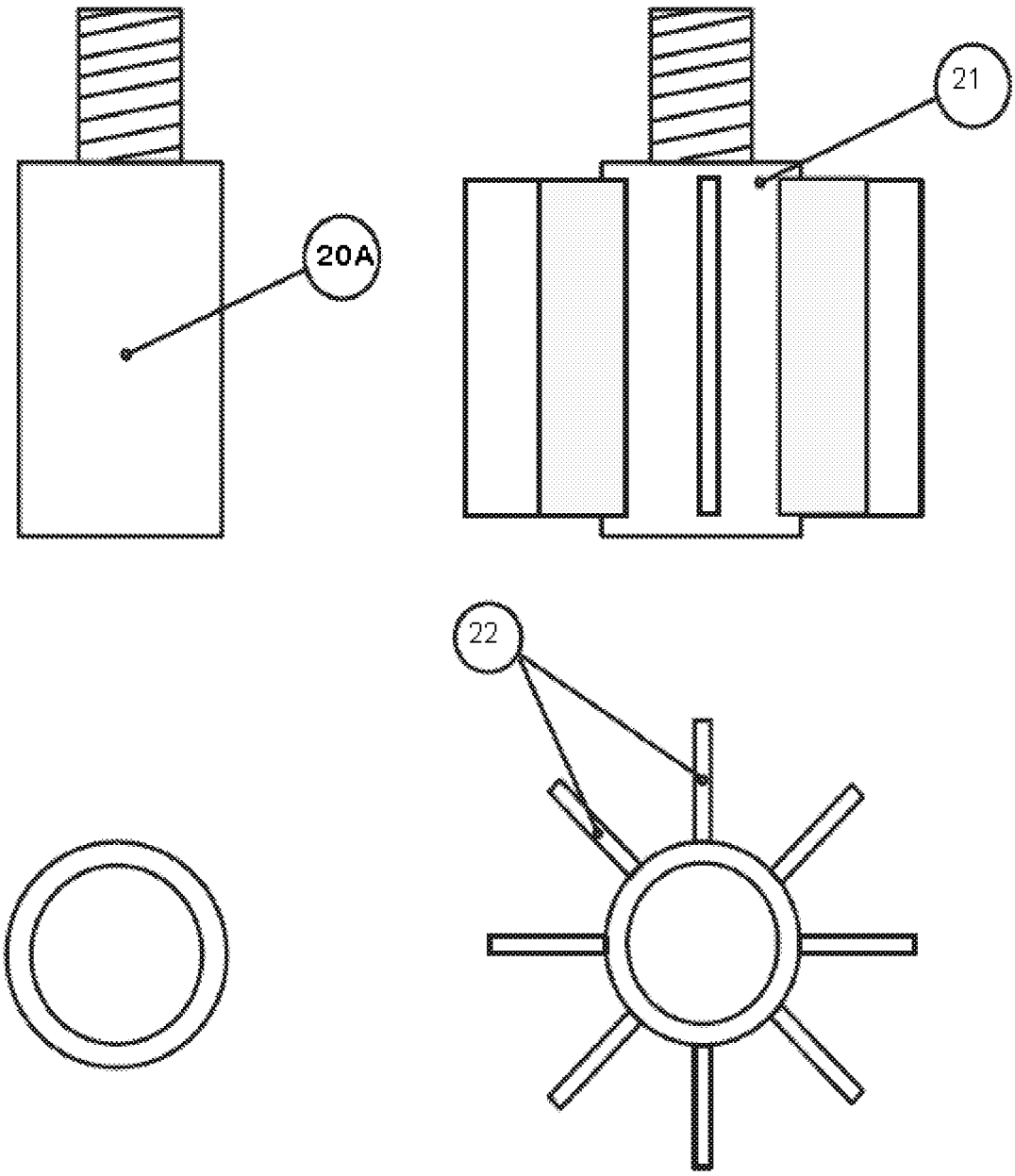
FIG. 7 is an exemplary illustration of safety valve heating fins.

As shown in FIG. 7, safety valves 20A are used to prevent excessive pressures in the system. Said valves are generally used in the industry for this type of application. However, a common problem with the safety valve is that the extremely cold temperature of the liquid Nitrogen flowing through the valve can cause the valve to stick and remain open, when it should have closed. Further, this flow causes the valve temperature to plummet, which substantially increases the potential for a runaway condition, keeping the valve open continuously and needlessly, wasting large amounts of Nitrogen. This failure is known in the industry as "sticky valve".

To reduce this problem, heating fins 22 are added to the newly designed safety valve 21 in the preferred embodiment. These fins 22 keep the temperature of the valve warmer during pressure relief, thus significantly reducing the sticky valve problem.

In one embodiment, a shipping containment vessel includes a payload bay with a length of copper tubing immediately outside the payload bay, which provides cooling when the Nitrogen is flowing through the copper tubing. A thermal box is placed immediately outside the copper tubing, which effectively thermally seals the payload bay from the outside environment, significantly reducing cooling losses. A cryogenic tank is used for storing liquid nitrogen coolant. An electronic controller maintains a set point for the payload bay, determined by the operator, prior to shipment. A shipping pallet of sufficient size is used to support the cryogenic tank, the freezer, the electronics and all remaining system components independently and autonomously. A pneumatic latch prevents accidental opening of the payload bay compartment door. A pneumatic rubber seal provides an airtight seal for the payload bay. The electronics and mechanics that controls product shipping compartment temperatures consistently within a specified range of the set point throughout the shipment duration. Reliability is increased through a redundant cryogenic valve 25 in parallel with main cryogenic valve 6 and a separate controller and temperature sensor. A mechanical valve 24 is used in parallel as a third redundancy.

The cryogenic liquid, Nitrogen, does not come in contact with the customer's product or any item in the product storage compartment, but rather has an exhaust with ports 11 outside the payload bay and eliminates the "direct inject" problems. The Nitrogen exhaust gas is routed through a hose that may be ported outside a Semi-trailer, a ship's cargo hold or an airplane. An Oxygen sensor with an alarm can be attached to the assembly, reducing the concern for Oxygen concentration levels below 17%, that might possibly occur in a failure.

The shipping pallet is designed with the appropriate holes to accommodate a fork lift. The copper tubing is protected from extreme pressures with a safety valve. The safety valve has a mechanism to prevent a failure known in the industry as a "sticky valve", through the attachment of heat exchanger fins to the outside diameter of the safety valve.

A pneumatic latch 23 and pneumatic rubber seal 19 are powered by the pressure derived from the Nitrogen exhaust gas 26.

The Nitrogen tank is of sufficient size to provide the payload bay cooling to a specified set point for the shipping duration of 10+ days. The assembly requires no external power of any kind for the duration of the shipping interval. The assembly has a net thermal effect of reducing the temperature of the surrounding environment, rather than increasing the temperature, which occurs with prior art mechanical shipping units.

The electronics includes an interactive Human Machine Interface or HMI. The HMI has a touch screen display. The electronics also includes a data logging system with real time data, plotted on the display and recording temperature and time throughout the shipment. The electronics also includes the capability of transmitting data logging information. The electronics includes a GPS system for tracking location remotely during shipment.

The product shipping compartment temperature control is provided by a cryogenic valve that is precisely controlled by the electronics. Further, the temperature control is achieved through the use of PID or another algorithm known to those skilled in the art.

The entire product is self contained on a pallet and totally energy independent for the duration of shipping.

The cryogenic temperature control valve is placed in the exhaust path of the Nitrogen gas. The location provides a warmer temperature location and promotes longer valve operating life than the standard location that is on the substantially colder incoming side of the freezer.

The entire Nitrogen flow is a closed system and the liquid Nitrogen and the Nitrogen gas never comes in direct contact with the customer's product or the person using it. The system is emission free and contains no polluting refrigerants such as CFCs or HCFCs. The entire cooling system is highly reliable due to almost no moving parts. Preferred embodiment has no engine and no refrigeration compressor, thus alleviating the customer from the wear problems associated with the multiplicity of moving parts in current shipping unit designs.

The shipping pallet supports the cryogenic tank, the freezer, the electronics and all remaining system components independently and autonomously. Mission critical payloads may be protected with an option of an entirely redundant valve, thermostat, and thermal sensor. The operation of the freezer system has the advantage of cooling rather than heating the local environment or shipping container.

Figure 8:
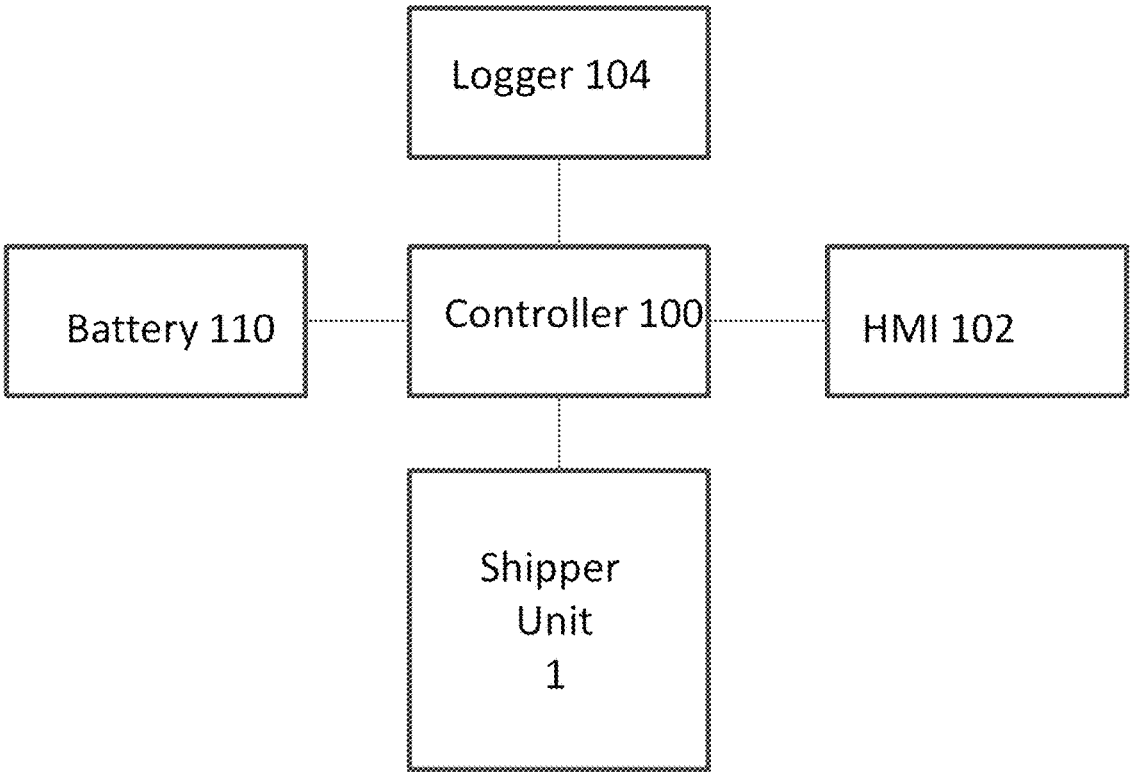
FIG. 8 shows an exemplary control electronics for the shipping unit.
Figure 9:
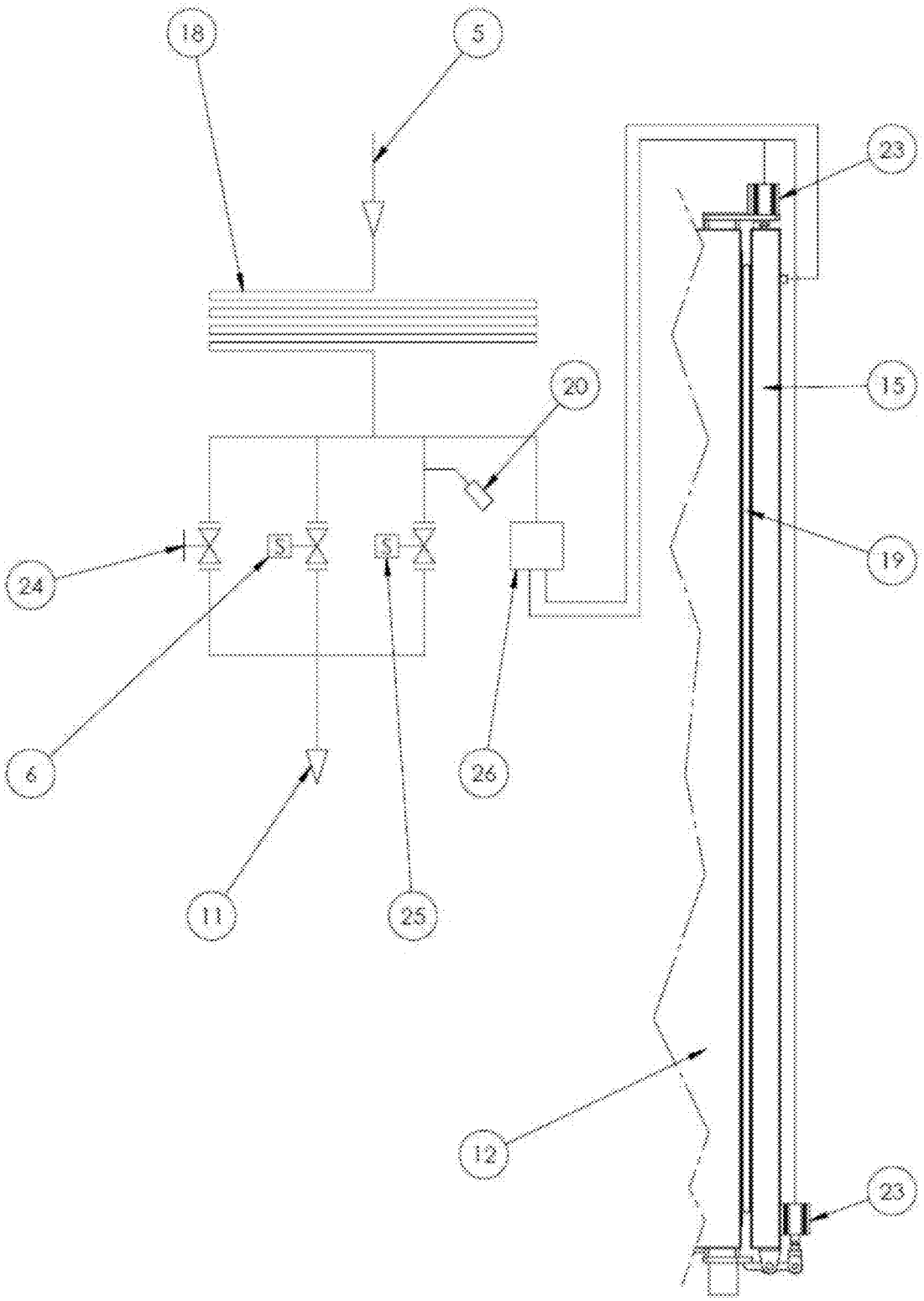
FIG. 9 shows a diagram of redundancy operations in the shipping unit.

FIG. 8 shows an exemplary Shipper with a controller 100 and a battery unit 110 for the shipper unit 1. The control electronics includes an interactive Human Machine Interface or HMI 102. The HMI has a touch screen display. Said electronics also includes a data logging unit 104 with real time data, plotted on the display and recording temperature vs time. The electronics also includes the capability to transmit data logging information. The payload bay temperature control is provided by a cryogenic valve that is precisely controlled by the electronics. Further, said temperature control is achieved through the use of PID or another algorithm known to those skilled in the art. Deep cycle batteries 110 maintain power during the shipment of product to its destination. Additional customer product thermal safety is provided by an emergency mechanical valve that regulates shipper temperature. A pneumatic latch and pneumatic rubber seal can be used and can be powered by the pressure derived from the Nitrogen exhaust gas. The safety valves have a mechanism to prevent a failure known in the industry as a "sticky valve", through the attachment of heat exchanger fins to the outside diameter of said safety valve. The assembly has a net thermal effect of reducing the temperature of the surrounding environment, rather than increasing the temperature, which occurs with prior art mechanical freezers. The cryogenic temperature control valve is placed in the exhaust path of the Nitrogen gas. Said location provides a warmer temperature location and promotes longer valve operating life than the standard location that is on the substantially colder incoming side of the freezer. The system is emission free and contains no polluting refrigerants such as CFCs or HCFCs. The entire cooling system is highly reliable due to almost no moving parts. The entire Nitrogen flow is a closed system and the liquid Nitrogen and the Nitrogen gas never come in direct contact with the customer's product or the employees.

For example, a forty-foot shipping container may be loaded with approximately 20 metric tons or more of super-frozen product (e.g., tuna loins) at a first location and shipped to a second location. Upon arrival at the second location (e.g., a distributor, wholesaler, or centralized warehousing facility), a cryogenic cooler is interfaced to the shipping container providing for automatic regulation of the super-frozen temperatures in the interior thereof. The super-frozen product may be stored for an indefinite time at the second location prior to being shipped to one or more third locations. The product may be shipped to the third locations in the same forty-foot container or in one or more smaller containers, such as but not limited to ISO LD3 containers 60'. At the one or more third locations a cryogenic cooler 20' may be interfaced to the shipping container to provide for automatic regulation of the super-frozen temperature in the interior thereof. This process may be repeated until the product is ultimately defrosted and/or consumed, e.g., at a supermarket, hotel, or restaurant.

Advantageously, providing storage capability at the second location (e.g., in container 60 at a distributor site) enables the use and delivery of bulk liquid carbon dioxide. This may enable a distributor to produce dry ice (i.e., solid carbon dioxide) from the bulk liquid. The process of delivering super frozen product to one or more third locations consumes a significant volume of dry ice. Provision of liquid carbon dioxide at the distributor site for storage in a container (e.g., container 60) provides for the on-demand production of dry ice at a relatively low cost and substantially eliminates the need for a distributor to maintain regular deliveries and/or dry ice inventories at relatively higher cost.

The cryogenic cooler of this example was coupled to a forty foot ISO certified container, which was filled with fish disposed at a super-frozen temperature. The cryogenic fluid supply coupling was coupled to a liquid nitrogen tank. The cryogenic cooler successfully maintained the temperature of the interior of the container at or below negative 50 degrees C. Super frozen fish was periodically removed from the container, defrosted, and tested for quality. The fish was found to be of a high quality, suitable for consumption as sushi. Further, 300 pounds of super frozen fish and dry ice was loaded from the above-mentioned container into an LD3 container and shipped by air to Chicago, U.S.A, where it was defrosted and found to be suitable for consumption as sushi.

The skilled artisan should recognize that although specific exemplary embodiments have been shown and described herein, which dispense cryogenic gas to attain desired super-frozen temperatures, the skilled artisan will recognize that conventional mechanical systems that typically employ a compressor, condenser, and a coolant circulating within a closed system, may be employed, in which the term 'cryogenic gas' will refer to cooled air or other fluid being generated by such mechanical system, without departing from the spirit and scope of the present invention.

The modifications to the various aspects of the present invention described hereinabove are merely exemplary. It is understood that other modifications to the illustrative embodiments will readily occur to persons with ordinary skill in the art. All such modifications and variations are deemed to be within the scope and spirit of the present invention as defined by the accompanying claims.

The following example illustrates one embodiment of the cryogenic cooler of this invention. The scope of this invention is not to be considered as limited by the specific embodiment described therein, but rather as defined by the claims.

Other embodiments are within the scope and spirit of the appended claims. For example, air could be forced up through the equipment racks 18. Air moved through the racks 18 could be of varying temperatures, including hot air. The shipping container 10 may be configured to distribute gases other than air. Additionally, a refrigerant or other coolant may be used rather than cold water. Further, a controller can be coupled to the shipping container 10 to monitor air temperatures and flow rates, as well as power supply so that each rack is provided adequate power consistently. A shipping container may contain a single equipment mobile cryogen unit 18 having a single cooling unit 16 creating an individual shipping container, whereby power is distributed to a single shipping container 10 or multiple single-rack shipping containers simultaneously.

In one embodiment of the present invention, one or more cooling units are centrally located in the modular shipping container to try to equalize the draw of hot air from each of the racks into the cooling unit. In other embodiments, the cooling units may placed in other locations, and in one embodiment, one or more cooling units may be positioned to be closest to a rack or racks that generate the greatest heat in the modular shipping container.

Further, in embodiments of the present invention, the roof over the hot area may include a number of fans that are controlled to exhaust air from the hot area in the event of a failure of an air conditioning unit in the modular shipping container, and/or when air temperature in the hot area exceeds a predetermined limit or if air pressure in the hot area exceeds a predetermined limit.

In embodiments of the invention described above, racks of modular shipping containers are described as being arranged in two rows. In other embodiments, the racks can be arranged in other geometrical configurations. Further, on sides of a modular shipping container, one or more racks can be used in addition to or in place of one or both side panels.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting. The invention's limit is defined only in the following claims and the equivalents thereto.

What is claimed is:

1. A shipping system to fit in a bulk shipping space, comprising:

a base with a quick connect post and a controller coupled to one or more proximity sensors on the quick connect post to detect a configuration of either a single subunit or stacked subunits; and first and second stackable cryogenic shipping subunits positioned on the base, each subunit having one or more feet on a subunit bottom adapted to rest above a plurality of corresponding foot receptacles on a subunit lid, each subunit having its own cryogen connection source to maintain temperature during transit down to −150 deg C.; and a first proximity sensor adapted to couple a first thermostat to a thermal sensor in the first subunit, and a second proximity sensor adapted to couple a second thermostat to a temperature sensor in the second subunit.

2. The system of claim 1, comprising insulated walls.

3. The system of claim 1, comprising a supply line coupled to a vaporizer, wherein the supply line comprises a vacuum insulated piping (VIP) line.

4. The system of claim 1, wherein the cryogen flows in parallel and introduces equal amounts of cryogen to tubings.

5. The system of claim 1, wherein the cryogen is proportionally flow controlled into a heat exchanger based on real time data.

6. The system of claim 1, wherein a cryogen flow is based on the cryogen liquid temperature and a shipping container heat load.

7. The system of claim 1, comprising:

a shipping foundation;

a cryogenic tank secured to the shipping foundation, a payload bay to receive products therein;

a tube connected to the cryogenic tank and thermally coupled to the payload bay;

a housing secured to the shipping foundation, said housing covering the tube and the payload bay to thermally seal the payload bay from outside environment; and a controller mounted on the housing and having a sensor to determine temperature in a closed-loop and maintaining a set point within a predetermined range.

8. The system of claim 1, comprising a shipping foundation including a pallet with openings to receive forklift arms.

9. The system of claim 1, comprising an exhaust gas hose for porting gas outside a semi-trailer, a ship's cargo hold, or an airplane.

10. The system of claim 1, wherein cryogen does not come in contact with the customer's product or any item in the product storage compartment.

11. The system of claim 1, comprising an oxygen sensor and an alarm to monitor oxygen concentration.

12. The system of claim 1, comprising a shipping foundation with openings to receive fork lift arms.

13. The system of claim 1, wherein a tubing is protected from high pressure with a safety valve.

14. The system of claim 1, wherein a pneumatic latch and pneumatic rubber seal are powered by the pressure derived from Nitrogen exhaust gas.

15. The system of claim 1, comprising a mechanical valve to manually regulate temperature.

16. The system of claim 1, comprising pneumatic latch and pneumatic rubber seal powered by the pressure derived from an exhaust gas.

17. The system of claim 1, comprising a controller with one or more setpoint limits so that when the return air temperature reaches a setpoint, a cryogen flow is started.

18. The system of claim 1, comprising a sensor to monitor the heat exchanger temperature and to engage a defrost cycle.

19. The system of claim 1, comprising:

a heat exchanger coupled to a cryogenic supply tank to receive a cryogen; and a port coupled to the heat exchanger, the port receiving ambient air and heat from the shipping container; and fans coupled to the heat exchanger.

20. The system of claim 1, wherein the bulk shipping space comprises a forty foot container with six or twenty-two modular sub-units.

* * * * *